United States Patent [19]

van Laere

[11] Patent Number: 4,905,423

[45] Date of Patent: Mar. 6, 1990

[54] ELECTRIC ROTARY POWER TOOL APPARATUS HOLDABLE BY HAND DURING OPERATION, KIT COMPRISING THE SAME, AND NOVEL SWITCH MEANS THEREFOR

[76] Inventor: Christiaan G. M. van Laere, Rainstrasse 86, CH-8038 Zürich, Switzerland

[21] Appl. No.: 226,208

[22] Filed: Jul. 29, 1988

Related U.S. Application Data

[60] Division of Ser. No. 879,458, Jun. 27, 1986, Pat. No. 4,822,958, which is a continuation-in-part of Ser. No. 594,797, Mar. 29, 1984, Pat. No. 4,619,162, which is a continuation-in-part of Ser. No. 430,763, Sep. 28, 1982, Pat. No. 4,505,170.

[30] Foreign Application Priority Data

Sep. 24, 1983 [EP] European Pat. Off. ..... 82109525.2

[51] Int. Cl.[4] ..... H01H 9/00; H01H 21/00

[52] U.S. Cl. ..... 51/181 R; 81/464; 310/47

[58] Field of Search ..... 51/181 R; 74/421 A; 81/57.11, 57.12, 57.13, 57.14, 463, 465, 466, 464; 173/47, 93.5; 310/66, 68 A, 47, 50, 78, 83; 200/1 V, 51 R, 155 R, 157

[56] References Cited

U.S. PATENT DOCUMENTS

| | | | |
|---|---|---|---|
| 3,196,298 | 7/1965 | Kent | 310/50 |
| 3,319,093 | 5/1967 | Abdul | 310/50 |
| 3,651,707 | 3/1972 | Rees | 310/50 |
| 3,665,228 | 5/1972 | Jacyno | 310/50 |
| 4,078,589 | 3/1978 | Miller | 310/50 |
| 4,081,704 | 3/1978 | Vassos et al. | 310/50 |
| 4,164,670 | 8/1979 | Maher | 310/50 |

FOREIGN PATENT DOCUMENTS

| | | | |
|---|---|---|---|
| 22555 | 7/1981 | Japan | 310/47 |

*Primary Examiner*—Frederick R. Schmidt
*Assistant Examiner*—Blynn Shideler
*Attorney, Agent, or Firm*—Wells & White

[57] ABSTRACT

A power tool apparatus which is hand-holdable during operation serves for facilitating especially heavy duty work, e.g. on a high scaffolding. The apparatus is composed of three building blocks, a central one haivng an elongated enveloping shell and an integral transverse wall dividing the shell into a forward and a rearward compartment. The latter contains a speed-reducing transmission unit and has a motor unit attached to the shell rear end. As a third building block the operator equipped with a kit according to the invention has the choice of several inset units, among them a simple front end wall with an intermediate shaft, and the same end wall and an impact-generating unit on the intermediate shaft, which inset units he can introduce through the open front end of the enveloping shell and exchange them as required without taking apart the transmission unit or detaching the motor unit. A handle can likewise be attached to the central shell unit. Various novel types of switches are also provided for use at the rearward end of the motor and/or with the handle.

16 Claims, 21 Drawing Sheets

ELECTRIC ROTARY POWER TOOL APPARATUS HOLDABLE BY HAND DURING OPERATION, KIT COMPRISING THE SAME, AND NOVEL SWITCH MEANS THEREFOR

This is a division of application Ser. No. 879.458, filed June 27, 1986, now U.S. Pat. No. 4,822,958, which is a continuation-in-part of application Ser. No. 594,797, filed Mar. 29, 1984, and now U.S. Pat. No. 4,619,162, which in turn is a continuation-in-part of application Ser. No. 430,763, filed Sept. 28, 1982, and now U.S. Pat. No. 4,505,170.

BACKGROUND OF THE INVENTION

This invention relates in a first aspect to an electric rotary power tool apparatus holdable by hand during operation; in a second aspect to a kit comprising the novel apparatus, and in a third aspect to novel switch means therefor.

The power tool apparatus according to the first invention aspect consists essentially of (A) a first building block comprising (1) an apparatus casing consisting essentially of an elongated assembly having a longitudinal axis and comprising (1.1) an enveloping shell extending generally in the direction of the said longitudinal axis, and having an open front end and an open rear end; and being of one piece;

(1.2) a first transverse wall extending across the interior of the shell in a region thereof intermediate the said front end and the said rear end axially spaced from both these ends so as to divide the shell interior into a forward chamber and a rearward chamber; the first transverse wall has a throughhole therein and is integral with the said shell;

(1.3) a second transverse wall across the open rear end of the shell and being detachably mounted therein; the second transverse wall has an opening therein; and (1.4) a speed-reducing unit which is mounted on the second transverse wall on the side thereof facing toward the first transverse wall, and comprises a driven power-transmitting shaft having a driven shaft front end adapted for fitting into the said throughhole and protruding therefrom into the forward chamber of the shell;

(B) a second, rearward building block comprising (2) a motor comprising, in turn, (2.1) a motor housing having a central longitudinal axis substantially parallel with the elongated assembly axis, and comprising a surrounding hull, a forward hull end, a rearward hull end wall, and being adapted for having the front end thereof rigidly connected with the second transverse wall on the outside of the latter;

(2.2) driving motor shaft means extending through the interior of the motor housing and being rotatably supported in the opening of the second transverse wall; the driving rotor shaft means have a forward shaft end extend into the rearward shell chamber and are adapted for drivingly engaging the said speed-reducing unit therein; and (3) insertable bearing-wall means adapted for being mounted transversely in rigid, detachable connection, in the said open front end of the enveloping shell, and having a central axial throughhole; these insertable bearing-wall means comprise (3.1) shaft-bearing means in the axial throughhole in which a driven power-transmitting shaft of the power tool apparatus can be supported.

An apparatus of the type described hereinbefore has been disclosed by V. Raso and A. C. Eisenhart in their U.S. Pat. No. 3,434,366 granted Mar. 25, 1969.

However, this known apparatus is not intended to be held by hand, especially during operation, but is to be mounted stationary on a solid base 5 on supporting feet 156 (FIG. 1 of U.S. Pat. No. 3,434,366).

If it were adapted to be used by hand it could be used for short tools such as sockets for tightening and loosening nuts or for screwdrivers. However, no heavy duty work could be done with such a power tool, when of reduced size to render it holdable by hand, as the apparatus lacks power-enhancing means such as an impact clutch or the like and could not support the same inside the forward housing of the frame or enveloping sleeve which is only intended to house a gear reduction unit distributed over both the forward and the rearward chamber which are formed in the frame of the Raso et al reduction unit.

A known electrical switch adapted to be mounted on the end part of an electric motor next adjacent the commutator thereof has been described in U.S. Pat. No. 3,681,550 issued on Aug. 1st, 1972 to Perry and Brockelsby. In this known electrical switch, contractor pins 66 extend from a rearward outer plate 62 corresponding to a cap member end wall, infra, in a switch structure through an intermediary cap member 54 into a pivotable brush mounting plate 40 in which there are housed four brushes 47 which are urged with their contactable forward end faces against an insulating wafer 26 having four openings 32 to 35 therein. As the brushes come to register with these openings owing to rotation of the brush mounting plate relative to the wafer, the brushes will penetrate through the openings and come into contact with a conically-shaped surface composed of commutator segments. Flexible wire connections are provided within the brush mounting plate and connect the brushes with the ends of the connector pins lodged in the brush mounting plate.

This known switch is thus of rather complicated structure and suffers from a considerable number of points where the various elements are subject to relatively rapid wear.

In the prior power-tool apparatus known to me, an exchange of impact means or the like present in a forward chamber of the apparatus casing is only provided for by making the forward part of the apparatus casing detachable from the rearward part thereof housing the speed-reducing unit. After the forward apparatus part has been detached, the impact clutch or the like power-transmitting means housed therein can be withdrawn from the forward chamber only by way of the rearward end of the forward part, or, depending on the structure of each casing, part or all of the speed-reducing unit must be removed, before another type of power-transmitting unit can be inserted in that forward chamber.

This is the case in the power tool apparatus described in my U.S. Pat. No. 4,505,170 dated Mar. 19, 1985; in U.S. Pat. No. 4,368,784 to Wünsch et al, granted on Jan. 18, 1983; in German Offenlegungsschrift DE 30 07 630, applied for by Rodac Pneumatic Tools, Carson, Calif., and published on Mar. 12, 1981 (U.S. application Ser.

No. 70149 filed on Aug. 27, 1979); in German Offenlegungsschrift DE 30 15 423, applied for by Robert Bosch GmbH, Stuttgart, Germany, and published on Oct. 29, 1981; and in Swiss Pat. No. 553,625 granted to Atlas Copco Aktiebolaget, Nacka, Sweden and published on Sept. 13, 1974.

OBJECTS AND SUMMARY OF THE INVENTION

It is a first object of this invention to provide a novel electric rotary power tool apparatus which is holdable by hand, powerful enough for heavy duty work, and of a configuration well balanced in hand, also when a heavy duty tool is attached via suitable, known transmission means, to the driven shaft of the speed reducing unit.

It is another object of the invention to provide an electric rotary power tool apparatus holdable by hand during operation, which permits the operator to rapidly exchange tools while working with the apparatus.

It is a further object of the invention to provide a power tool apparatus holdable by hand during operation and having a forward housing part integral with the remaining housing thereof, into which power-transmitting means of different types, among them also impact clutches and the like, can be inserted without separation of the forward housing part, thereby facilitating rapid exchange of different types of insets, in particular during heavy duty work being carried out with the apparatus.

It is yet another object of the invention to provide a kit comprising the novel electric rotary power tool apparatus as well as a set of a great variety of light and heavy duty tools which can be exchanged easily by the operator even when at such working sites as scaffoldings of a high building.

It is still another object of the invention to provide a novel type of electric switch particularly for switching direct electrical current, with a minimum of power loss also when switching strong electrical currents having a potential of preferably from 8 to about 40 volts and an amperage sufficient for affording a power input into the electric motor of at least about 180 watt, when idling, and at least 620 watt when under load.

It is furthermore an object to provide an electrical switch adapted to be mounted at the rear end of an electric motor next adjacent a commutator mounted on the rotor shaft of the motor, which switch is distinguished by a reduced number of elements of greatly simplified structure in which the number of points at which wear of parts may occur as well as the rate of wear of such parts have been reduced considerably.

These objects are attained, as described hereinafter, in an apparatus of the initially described kind, in which the rearward chamber of the enveloping shell is destined to receive therein the entire speed-reducing unit which is adapted to fit in that chamber; as well as by novel switch means described further below.

The transverse wall in the central region of the enveloping shell, which wall is an integral part of the shell body, is destined to receive in its opening the driven output shaft of the speed-reducing unit which latter is confined to the rearward chamber of the enveloping shell. The forward chamber in this shell is destined to receive therein (C) a third, inset building block adapted for being practically completely inserted therein by way of the open front end of the said forward shell chamber, and comprising, besides the initially described shaft-bearing means, (3.2) intermediary power-transmitting insert means comprising (3.2.a) insert shaft means having a forward and a rearward shaft end, of which the rearward shaft end is adapted for driving engagement with the driven shaft front end protruding into the forward shell chamber; the insert shaft means are supported for rotation in the shaft-bearing means in a region of the insert shaft means near the forward shaft end thereof; and (3.2.b) a connecting piece on the forward shaft end and forward of the shaft bearing means;

(3.3) centering socket means adapted for protruding forward out of the enveloping shell and being located spaced outwardly from said throughhole; and (3.4) tool fastener-engaging means adapted to be located outside the shell and spaced outwardly of the axial throughhole. These may, for instance, be boltholes.

As further important features of the invention, (i) the length of the enveloping shell forward chamber from the integral first transverse wall to the open shell front end must be sufficient for receiving in its interior all parts of the third building block that are located rearward of the central axial throughhole in the insertable bearing-wall means; and (ii) the wall thickness and strength of the enveloping shell must be sufficient for supporting, when held freely by hand during operation, in combination with the first building block, the entire second, rearward building block comprising the motor mounted on the second transverse wall, as well as the entire third, inset building block even when comprising heavy duty impact clutch means or the like, as part of the said intermediary power-transmitting insert means.

Of course, the open front end of the enveloping shell must be wide enough to permit easy insertion of such power-transmitting units as impact clutches, fan means and the like.

Preferably, the aforesaid speed-reducing unit comprises a gear train consisting essentially of a plurality of gears and a number of transmission shafts each bearing at least one gear, one of which gears is a pinion adapted for being mounted on the forward shaft end of the driving rotor shaft means, and one of the transmission shafts is comprised by the said driven power-transmitting shaft means; the transmission shafts are supported in the first and second transverse walls, respectively. Optimal power output is obtained when the ratio of the speed of the driving rotor shaft means to the driven power-transmitting shaft means is from about 7:1 to about 12:1.

I have found the above-mentioned transmission ratio of from about 7:1 to 12:1 to be critical, because below and above that ration, even though the resulting speed of the driven shaft is about 1200 to 4000 r.p.m., the apparatus will fail to loosen severely jammed or seized bolts or nuts of automobile wheels in an increasing number of cases, the greater the difference from the above-stated range of ratioes. The choice of the transmission ratio is dependent on the idling speed of the driven shaft of the motor; thus, when that idling speed is 30,000 r.p.m., a transmission ratio of 12:1 is preferred. If as ratio of 7:1 were used, a flywheel effect might be produced by the impact mass and an impact-generating unit would be no more effective and might even be damaged.

The motor comprised by the rearward building block is preferably an electric motor comprising (2.3) a rotor mounted inside the motor housing on the driving rotor shaft means for rotating the latter;

(2.4) stator means adapted for generating an electric field for cooperation with said rotor; and (2.5) commutator means comprising (2.5.a.) a commutator consisting essentially of collector segments and being mounted on the driving rotor shaft means between the rotor and the said rearward motor housing end wall;

(2.5b.) first and second brush means mounted in the motor housing and biassed toward the collector segments for electrically conductive contact therewith to deliver, preferably direct, electric current to the rotor;

(2.5.c.) first and second fixed contactor means being electrically conductively connected with the first and second brush means, respectively, and being mounted stationary in the rearward building block and having terminal portions located outside the rearward motor housing end wall; the fixed contactor terminal portions bearing contactable surface regions located generally in a substantially planar contact zone; and (2.5.d.) electrically conductive lead means adapted for connecting the first and second brush means, respectively with the first and second fixed contactor means, substantially free from electrical power losses. This last-mentioned advantageous feature is achieved by providing lead means of a sufficiently large cross sectional area, and by avoiding at the junctions between the lead means and other conductive elements all soldered joints, using instead clamping-in connections ensuring metal-on-metal pressure contact.

In a preferred embodiment of the electric motor, the stator means comprise a stator mounted in the interior of the motor housing and being a permanent magnet of magnetic iron material, the permanent magnet comprising a north pole shoe and a south pole shoe of substantially semicylindrical configuration and having each a thickness of from about 5 to 6 mm, the pole shoes of the permanent magnet being concentrical with the longitudinal rotor axis; and opposite longitudinal gaps having each a circumferential width, in a radial plane, of about 33 mm and separating said two pole shoes from one another; the length of the permanent magnet being from about 30 to 65 mm; and the radial diameter of the assembled rotor and two pole shoes taken together being from about 42 to 45 mm;

and the rotor consists essentially of (i) a generally drum-shaped armature on the rotor shaft and having a substantially cylindrical surface section coaxial with the longitudinal rotor axis and with an external diameter of about 32 mm and a length of from about 26 to 55 mm, the armature having 12 axially extending cutout channels parallel with the longitudinal rotor axis and opening out of the external surface section of the armature; the internal diameter of said armature between the deepest ends of every two diametrically opposite cut-out channels being from about 16 to 17 mm, (ii) a wiring of electrically conductive wire having a diameter of each individual wire cross section of from about 0.56 to 0.72 mm and comprising a plurality of wire portions, each of the channels containing about 30 to 37 of the wire portions, and (iii) the commutator comprises 12 collector segments and is mounted on the rotor shaft; and the total length of wire amounts to from about 12 to about 24 meters.

All measures are taken to ensure a minimum of resistance losses in the paths of direct electric current between the current source and the collector segments of the motor armature. Thus, the cables used to connect the +pole and the −pole of the battery with the corresponding connecting contactor elements of the switch preferably comprise a parcel of fifty wires each being 0.25 mm thick, the parcel having a diameter of 2.5 mm, when a normal car battery is being used, while, in the case of a truck (lorry) battery the parcel has a diameter of about 3 mm and consists of fifty wires each having a thickness of 0.38 mm.

The electric motor is preferably devised to be fed an electric direct current from an automobile battery having a nominal voltage of 12 volts and an operational voltage of at least 10 volts, a power output of at least 250 watt; and the idling speed of the motor at that voltage ranges from about 10,000 to 25,000 r.p.m., the transmission ratio is 7:1 to 12:1 and the driven shaft has correspondingly an idling speed of about 1200 and up to 4000 r.p.m., and preferably a speed from about 1200 to 2200 r.p.m.

Most preferred is an idling speed of the motor of from 13,000 to 15,000 r.p.m.

It would have been expected that such high speed which means less strength of the motor, would be too weak and therefore fail to loosen severely jammed or seized bolts or nuts when a speed of 7000 r.p.m. would fail if the motor receives its direct current from a 12 volt-automobile battery.

When the energy is supplied to the power tool apparatus according to this first invention aspect from a 12 volt-automobile battery, then the speed of the driving motor shaft, at the nominal voltage of 12 volts, should at least be 4000 r.p.m. under full load.

The amperage of the power source (preferably a car battery of 12 or 24 volts) delivered to the tool apparatus according to the invention under load should be at least 20 and preferably 125 up to 150 amperes, and from 180 amperes up to 300 to 400 amperes for heavy duty work.

The rearward building block further preferably comprises (4) an electrical switch means being adapted for switching a direct electrical current having an electric potential of from 8 to about 40 volts and an amperage sufficient for affording a power input of the electric motor of 180 watt, when idling, and, under load, of 620 watt. These electrical switch means according to the invention comprise (4.1) a supporting member having at least one electrically insulating face located spaced from, and substantially parallel with, the above-mentioned substantially planar contact zone, in which the contactable surface regions of the fixed contactors are located; this insulating face is also located remote from the rearward motor housing wall and the said planar contact zone. The contactable surface regions of the terminal fixed contactor portions are preferably arranged about a common central switch axis extending normal with regard to the contact zone; and the supporting member is mounted in the rearward building block to be adapted for pivoting displacement about the said central switch axis, between a neutral position and at least one activating position.

The novel switch means further comprise (4.2) socket throughholes extending through the supporting member and opening out of the electrically insulating face thereof; they are preferably adapted for receiving therein each a prong of an electrical plug having at least two prongs and being electrically connectable to a source of electric current. The switch means further comprise:

(4.3) at least two shiftable contactor elements being mounted on the electrically insulating face of the supporting member so as to be electrically insulated from each other, and each of the contactor elements is located so close to a different one of the throughholes in the supporting member face as to make substantially loss-free contact with a prong of a plug inserted in the respective throughhole; and wherein each of said shiftable contact members has a shiftable contact face extending in an arc about and on opposite sides of said central switch axis; and (4.4) biassing means mounted in the rearward building block and being adapted for biassing the shiftable contactor elements toward the fixed contactor means and thereby urging the contact faces of the shiftable contactor elements into the substantially planar contact zone; the contact faces which extend in the said arcs are separated by gaps between them exposing non-conductive areas which the said biassing means urge against the contactable surface regions of the terminal fixed contactor portions when the supporting member is in neutral position, thereby preventing electric current flow from said shiftable contact faces into the said contactable surface regions. However, these non-conductive area gaps are sufficiently small for permitting current flow, when the supporting member is pivoted by a small angle about the central switch axis and away from its neutral position, from a source of electric energy via the plug prongs and the shiftable contact faces into the contactable surface regions, thereby energizing the electric motor.

In preferred embodiments of the apparatus, the rearward building block further comprises (5) a cap member adapted for covering the rearward motor housing end wall as well as a substantial portion of the surrounding hull of the motor housing on the outside, and having a cap end wall extending substantially parallel with the rearward motor housing end wall and having an inner wall surface, whereby an internal chamber is left free between the inner cap wall surface and the rearward motor housing end wall;

the supporting member of the electrical switch means is located in this embodiment vis-á-vis the said inner face of the cap end wall, and cap throughholes are provided which extend from outside the cap end wall to the inner face thereof facing the supporting member.

Moreover, in this embodiment, the biassing means comprise first and second engagement means, mounted on the outside of the rearward motor housing end wall and on the insulating supporting member face, respectively; they cooperate with each other in biassing the supporting member toward the rearward motor housing end wall and, when said supporting member is in neutral position, they urge the non-conductive gap areas against the contactable terminal portion surface regions, and, when the supporting member is in an activating position, they urge the contact faces of the shiftable contactor elements against the contactable surface regions in the substantially planar contact zone.

The shiftable contactor elements when being arc-shaped preferably extend each over an arc constituting a major portion of a half circle about the central switch axis, and the arc-shaped contactor elements can have at least one end thereof beveled to form a ramp facilitating sliding of the contact face thereon on to the respective contactable surface region of the nearest fixed contactor terminal portion, when the supporting member is pivoted through a small angle from the neutral to an activating position.

Another advantageous embodiment of an electric switch according to the invention is constituted by an on-off reversing switch comprising supporting means, spaced from and pivotally mounted on an external face of the rear end wall of the motor housing and having an inner and an outer face both extending substantially transversely to the longitudinal rotor axis;

a pair of shiftable contactor means mounted in the supporting means and extending from outside the outer face thereof through the cap member and protruding from the inner face thereof toward the rear end wall of the motor housing, the supporting means having passage means for the introduction of a pair of lead means from a plus pole and a minus pole, respectively of an automobile battery or the like into the interspace between the rear end wall and the inner face of the cap member, and into electrically conductive engagement with a first and a second one, respectively, of the pair of shiftable contactor means, the shiftable contactor means being so disposed in the cap member as to be switched by corresponding turning of the cap member to adopt three different positions, in a first "off" one of which, parts of the shiftable contactor means at the inner face of the cover means are out of contact with both the first and second stationary contactor means, while in a second position, a first one of the shiftable contactor means makes contact with the first stationary contactor means lodged in the rear motor housing end wall on the outside thereof, and the second shiftable contactor means makes contact with the second stationary contactor means also on the outside of the rear end wall, thereby activating the motor for rotating the driving shaft in a given direction of rotation, and, in a third position, the second one of the shiftable contactor means makes contact with the first stationary contactor means, and the first shiftable contactor means makes contact with the second stationary contactor means, thereby reversing the direction of rotation of the motor and the driving shaft It is furthermore preferred that the electrical switch means comprise restoring means for returning the supporting member automatically from an activating position to its neutral position; these restoring means comprise a shaft member whose cross sectional area is of elongated configuration and has a larger diameter in a first direction and a smaller diameter in a second direction at right angle to the said first direction, and two elastically flexible blade members lie firmly and straight against opposite flanks of the shaft member spaced from each other by the said smaller diameter when the supporting member is in neutral position, and lying with biassing torque against two other opposite flanks of the shaft member, spaced by the said larger diameter from each other, when the supporting member is in an activating position: the resulting torque biasses the shaft member toward return to its neutral position, one of the two parts being constituted by the supporting member insulating face and the rearward motor housing end wall bearing the shaft member, and the other part being constituted by the two blade members.

In another embodiment of the switch according to the invention, the supporting member can have a circumferential rim and can be mounted in the cap member pivotably about the central switch axis; while the cap member is connected rigidly with the rearward motor housing wall; and the supporting member can then comprise (4.1.a) a switch-shifting member protruding tangentially from said supporting member rim; and the cap member can then be provided with a window registering with the switch-shifting member through which window the switch-shifting member protrudes when the supporting member is in neutral position; depression of the protruding end of the switch-shifting member causing the supporting member to turn about the central switch axis and shift from its neutral to an activating position.

In a kit containing the above-described novel power tool apparatus being holdable by hand during operation, there can be provided, as a supplementary part of the rearward building block (6) a handle part having at least two opposite handle sidewalls and being firmly connectable with the first building block, the handle part having a central longitudinal axis extending transverse relative to the longitudinal building block assembly axis;

while the electrical switch means further comprise (4.5) auxiliary stationary mounting means adapted for holding a third and fourth fixed contactor means firmly in position therein relative to a central switch axis extending normal to the mounting means; these auxiliary mounting means are mounted in the said handle part on an inside face of one of the opposite handle sidewalls;

while a special supporting member is mounted, pivotably relative to the last-mentioned central switch axis, on an inside face of the other handle sidewall, in cooperative juxtaposition to the fixed contactor means on the stationary mounting means.

In yet another embodiment of the electrical switch according to the invention, the special supporting member has a circumferential rim and comprises (4.1.a) at least one switch-shifting member protruding tangentially from the supporting member rim, while the handle part has window means through which the switch-shifting member is adapted to protrude at least when the supporting member is in neutral position; depression of the protruding end of the switch-shifting member will cause the supporting member to turn by a small angle about the last-mentioned central switch axis and will thus be shifted from its neutral to an activating position.

A similar embodiment of the apparatus according to the invention can be built up from a rearward building block which comprises, as part of the electrical switch means, (4.6) stationary mounting means adapted for holding the first and second fixed contactor means firmly in position therein relative to the first-mentioned central switch axis, and being mounted firmly on the outside of the rearward motor housing end wall;

while the first and second engagement means of the biassing means are aligned with each other along the said central switch axis and are pivotably connected with the cap member and the supporting member therein, and with the said stationary mounting means, respectively;

and the said switch means comprise further (4.7) restoring means being in engagement with the supporting member and comprising arresting means adapted for being held in the stationary mounting means so as to cause restoring bias applied to the supporting member when the latter is pivoted from neutral position to an activating position;

and the said rearward building block further comprises, as part of the kit, separately, (6) a handle unit having at least two opposite handle sidewalls and being firmly connectable with the first building block, the handle part having a central longitudinal axis between the handle sidewalls and extending transversely to the central longitudinal motor housing axis; and the opposite handle sidewalls have upper end portions adapted for freely supporting the cap member in a manner such that the said cap member and the said supporting member therein can be pivoted between neutral position and an activating position of the supporting member;

and the handle unit contains further (7) a second electrical switch having a second central switch axis and comprising (7.1) a pair of third and fourth fixed contactor means, (7.2) second stationary mounting means adapted for holding the third and fourth fixed contactor means firmly in position therein relative to the second switch axis, and being mounted in the handle part on an inside face of one of the said opposite handle sidewalls; and the third and fourth fixed contactor means have terminal portions protruding, into an interspace between the opposite handle sidewalls from the second mounting means, and bear fixed contactable third and fourth surface regions, respectively, located generally in a second planar contact zone;

(7.3) electrically conductive cord means extending through the handle unit, having two ends, one end of which cord means is connected to the third and fourth contactor means; while, at the other end thereof, the cord means comprise plug means adapted for being inserted through the cap member into contact with the contactable regions of the first and second contactor means;

(7.4) secondary throughholes in the cap member for rendering the contactable regions of the first and second contactor means accessible to contact by plug means inserted in these secondary throughholes;

(7.5) a second supporting member having at least one electrically insulating face located spaced from, and substantially parallel with the said second planar contact zone;

(7.6) handle socket throughholes opening out of the handle unit and being adapted for receiving in each throughhole plug-connecting means associated with an electrical plug being connectable to a source of electric direct current;

(7.7) at least two shiftable handle contactor elements being mounted on the said insulating face of the second supporting member so as to be electrically insulated from each other, and close to the said handle socket throughholes so as to make substantially loss-free contact with the plug-connecting means when the electrical plug mentioned under (7.6), supra, is connected to the handle socket throughholes;

(7.8) second biassing means mounted in the handle unit and comprising first and second engagement means mutually pivotably engaged and cooperating with each other in biassing the second supporting member toward the second stationary mounting means, while being pivotable relative to each other, together with the second supporting member and the second stationary mounting means;

and the second supporting member have a peripheral rim and comprise (7.5.a) at least one switch-shifting member tangentially protruding from the rim of the second supporting member, while the handle unit has window means through which the switch-shifting member is adapted to protrude when the second supporting member is in neutral position; whereas depression of the protruding end of the switch-shifting member will cause the supporting member to turn through a small angle about the second central switch axis and will thereby shift from its neutral to an activating position; and, lastly, the second switch comprises (7.9) second restoring means being in engagement with the second supporting member and comprising second arresting means being held in the second stationary mounting means so as to cause restoring bias to be applied to the second supporting member when the same is pivoted from its neutral position to an activated position.

In yet a different combination of the basic apparatus according to the invention and a handle part, the first and second engagement means of the biassing means are aligned with each other along their common central switch axis and are pivotally connected with the supporting member inside the cap member and with the rearward motor housing end wall, respectively; and the rearward building block comprises further the handle part described hereinbefore under (6), the opposite handle sidewalls having upper end portions adapted for freely supporting the cap member for rotating motion of the latter relative to the sidewalls between the rest position and an activating position of the supporting member; and the handle part comprises (6.1) pivoting means for causing a pivoting motion of the cap member from the said rest position to an activating position of the supporting member therein, which pivoting means are located in the handle part and extend into engagement with the cap member in an underside region of the latter intermediate the handle sidewalls; and (6.2) pivot-actuating means lodged in the handle part and adapted for being depressed from outside the handle part, thereby causing the cap member to pivot from the rest position to an activated position of the supporting member;

and the electrical switch means further comprise (4.7) restoring means for restoring the supporting member, and the cap member together therewith, automatically from an activating position to the said neutral position. The restoring means can be mounted in the handle part and can be in restoring engagement with the pivoting means therein.

On the other hand, the restoring means can be in restoring engagement with the supporting member and can comprise arresting means;

and the electrical switch means can further comprise (4.6) stationary mounting means adapted for holding the first and second fixed contactor means firmly in position therein relative to the central switch axis, and being mounted on the outside of the rearward motor housing end wall; while the arresting means are held in the stationary mounting means so as to cause restoring bias of the restoring means exerted on the supporting member when the latter is pivoted from its neutral position to an activating position.

In yet another embodiment of the apparatus according to the invention, the rearward building block can further comprise (5) a cap member as described hereinbefore under (5), and the first and second fixed contactor means extending to the cap end wall, (4.2) the socket throughholes extend through the cap end wall to the outside thereof and register with the contactable surface regions of the fixed contactor terminal portions and are adapted for receiving prongs of an electrical plug having at least two such prongs and being connectable to a source of electric current; whereby prongs inserted into the socket throughholes can be connected conductively with the contactable surface regions;

one of the first and second fixed contactor means has a circuit-breaking gap therein; and this embodiment of an electrical switch comprises a circuit making element mounted in the cap member and being adapted for radial inward displacement by outside pressure being applied thereto, so as to bridge the gap in the one fixed contactor means and thereby to make circuit; the circuit-breaking element is biassed into undepressed, circuit-breaking position.

According to the second aspect of the invention, a working kit suitable for hobby work as well as constructional and the like heavy duty work, comprises (I) an electric rotary power tool apparatus holdable by hand during operation and consisting essentially of (A) a first building block comprising (1) an apparatus casing consisting essentially of an elongated assembly having a longitudinal axis and comprising the parts defined under (1.1) through (1.4), supra, the speed-reducing unit comprising the gear train as defined supra, which reduces the speed of the pinion to that of the driven shaft in a ratio of from about 7:1 to about 12:1; and (B) a second, rearward building block comprising (2) a direct current electric motor comprising the parts defined, supra, under (2.1) through (2.5.c) as well as (2.5.d) electrically conductive lead means adapted for connecting the first brush means with the first fixed contactor, and the second brush means with the second fixed contactor, and being adapted for carrying direct electrical current of the voltage and amperage defined, supra, substantially free from electrical power losses;

(4) first electrical switch means being adapted for switching a direct electrical current having the voltage and amperage defined, supra, and comprising the parts (4.1) through (4.7) as defined, supra;

(5) a cap member adapted for covering at least a substantial portion of the surrounding hull of the motor housing and having a cap end wall extending substantially parallel with and spaced from the outside of the rearward housing end wall, an internal chamber being left free between the rearward hull end wall and the inner face of the cap end wall, through which internal chamber the first planar contact plane extends; and the first supporting means being located inside the cap member vis-á-vis the cap end wall;

those socket throughholes being associated with the two shiftable contactor elements of this first switch means extending from outside the cap member and through the latter and also through the first supporting member, and two other, additional throughholes extending from outside the cap end wall and through the first supporting member thereon, and opening out of the electrically insulating face thereof to register with the contactable terminal regions of the first and second fixed contactors, respectively, when the supporting member is in neutral position;

while the first and second engagement means of the first biassing means are pivotably engaged with each other, whereby the first supporting member in the cap member can be pivoted about the first central switch axis relative to the first mounting means by at least a small angle; and, when the first supporting member is in activated position, the biassing means urge the shiftable contactor elements against the contactable terminal regions of the first and second fixed contactors.

This kit according to the invention further comprises (II) at least one of the following kit items:

(a) an electrical cable having two ends and comprising at one end thereof connecting means for attachment to a source of direct electrical current, and at the other end an electrical plug comprising prong-receiving holes therein being electrically conductively connected, through the cable, with the connecting means, and prongs adapted for being mounted fixedly in at least one of (i) the socket throughholes of the first supporting member, and (ii) the prong-receiving holes of the plug;

(b) a handle part having at least two opposite handle sidewalls and being firmly and detachably connectable with the first building block, which handle part has a central longitudinal axis extending between the handle sidewalls and transversely to the central longitudinal motor housing axis, when the handle part is attached to the first building block;

and the opposite handle sidewalls are adapted for freely supporting the cap member and the first supporting member therein to be pivotable about the first central switch axis between the said neutral position and an activating position.

This handle part comprises (7) second electrical switch means adapted for switching a direct electrical current having the voltage and amperage defined, supra, and comprising, about a second central switch axis, the parts (7.1) through (7.9), described supra; and one end of the cord means comprises (6.1) a handle cord plug conductively connected with the other end of the cord means, through the latter; and (6.2) lead prongs on the cord plug adapted to be inserted, respectively, into the additional socket throughholes in the cap end wall and to make contact, through the first supporting member, with the contactable terminal regions of the first and second fixed contactors, respectively, while arresting the first supporting member in neutral position;

and the second supporting member comprises actuating means extending to the outside and having a depressable portion protruding to outside the handle part at least when the second supporting member is in neutral position; while depression of the depressable portion of the actuating means causes the supporting member to pivot about the said second central switch axis from its neutral position to an activating position;

(c) a portable battery adapted for being carried on an operator's person, in combination with battery cable means adapted for being connected to the portable battery, on the one hand, and being adapted to be connected, on the other hand, with one of (iii) the said two shiftable contactor elements of the first supporting member; or (iv) the shiftable handle contactor elements of the second supporting member;

(III) at least one of the following insert units all of which have the following features in common:

(3) insertable bearing-wall means adapted for being mounted transversely, detachably and in firm position in the open front end of the enveloping shell of the first building block, the insert bearing-wall means having a central axis throughhole and comprising (3.1) shaft-bearing means in the axial throughhole;

(3.2) an insertable power-transmitting intermediary unit comprising (3.2.a) insertable shaft means having a forward shaft end and a rearward insertable shaft end, the insertable shaft means being supportable for rotation in the shaft-bearing means engaging a region of the insertable shaft means near the forward shaft end, the rearward shaft end of the insertable shaft means being adapted, upon insertion into the forward chamber of the enveloping shell, for drivingly engaging the driven shaft front end protruding from the first transverse wall into the forward shell chamber;

(3.2.b) a square-head type connecting piece on the forward end of the insertable shaft means, and being located forward of the shaft-bearing means;

(3.3) centering socket means adapted for protruding forwardly out of the enveloping shell and being located spaced outwardly from the throughhole; and (3.4) tool-fastening means adapted for being located outside the enveloping shell and being spaced outwardly from the axial throughhole;

and these insert units are constituted by:

(8A) an insert unit consisting of the parts defined under (3) through (3.4), supra, per se;

(8B) an insert unit comprising, besides the parts defined under (3) through (3.4), supra, (8.1) fan means mounted on the insertable shaft means in a region thereof being located in the interior of the forward chamber, upon insertion of the unit therein; and (8.2) vent means provided in the transverse walls of the forward and rearward chambers of the enveloping shell, as well as in the insertable bearing-wall means;

(8C) an insert unit comprising, besides the parts defined under (3) through (3.4), supra, an impact-generating unit mounted on the insertable bearing-wall means and on the insertable shaft means;

(8D) an insert unit comprising, besides the parts defined under (3) through (3.4), supra, a hammer drill mounted on the insertable shaft means.

All of these insert units must fit with their parts rearward of their bearing-wall means, defined above, into the forward chamber of the enveloping shell; and the working kit according to the invention further comprises:

(IV) at least one of the following tools each of which comprises (9) coupling means adapted for firm, detachable and centered coupling of the respective tool with the centering socket means; and

(10) tool operating shaft means comprising a coupling shaft end adapted for being drivingly connected with the polygonal-type connecting piece at the forward end of the insertable shaft means, preferably with a square head piece; and is constituted by (IV.1) nut-loosening and tightening socket means;

(IV.2) screw driver means;

(IV.3) a drilling tool;

(IV.4) a blade saw tool;

(IV.5) an angle tool comprising at least one of sander and cutter means;

In order to provide a successful power tool apparatus according to this second invention aspect, the working kit preferably comprises an insert unit as defined under (8C) or (8D), supra, whose impact-generating unit comprises an impact mass separate from the motor and associated preferably with the tool socket means, mentioned under (IV.D), supra, for imparting impacts to the latter means.

This impact generating unit comprises an impact mass and preferably imparts impacts to the tool socket means at a frequency equal to the number of revolutions per minute carried out by the driven shaft.

A preferred impact-generating unit comprises an anvil having at least two anvil abutments, a hammer drum and at least two hammers thereon, the drum and hammers weighing together about 350 to 500 grams and having a radial diameter of about 50 to 55 mm; a hammer shaft connected with the driven shaft, the hammer drum being axially displaceable along the hammer shaft; and a drum spring supported in the impacting unit to urge the hammer drum and hammers into a position in which the hammers are enabled to impact upon the anvil abutments when the hammer shaft is rotated; the hammer drum spring having a length, measured along the rotor axis, of about 35 to 45 mm, and the compressibility of the hammer drum being 10 mm under a load of about 18 to 22 kg.

In order to prevent generation of excessively high reaction forces (which would exceed the strength of the operator holding the apparatus), the impact mass is urged by means of a spring against slightly sloped contact faces of the driven tool socket. The strength of the spring and the taper of the contact faces assures a continuous tightening or loosening of bolts and the like elements up to the moment when the reaction forces cause the impact mass to slip over a first sloped contact face and abut against the next following sloped contact face. The impact action only starts when the reaction forces surpass 50 Newtonmeters.

Another suitable impact-generating unit which can be equipped with the features defined hereinbefore under (3.3) and (3.4) as described under (8C) and (8D), supra, is the impact unit described by Georgy A. Antipov et al in U.S. Pat. No. 4,191,264, patented on Mar. 4, 1980. The shank 8 described in this patent is suitable for use as the square-head type connecting piece defined under (3.2.b), supra.

Automobile batteries have usually a nominal voltage of 12 volts, for passenger cars and 24 volts for trucks, lorries, buses, agricultural combustion engines and the like. The electric motor can therefore also be fed with D.C. from a 24-volt battery (operational voltage at least 20 and up to 28 volts).

In a further aspect of the invention, the electric motor is preferably dimensioned so as to be driven by an electric direct current having an operational voltage below 20 volts and, in particular, of about 9.5 to 14.5 volts; the speed of the said electric motor, at a nominal voltage of 12 volts, should preferably not exceed 15,000 r.p.m. when idling.

Such power tool apparatus having an electric motor of the last-mentioned characteristics is useful in particular for hobby work such as drilling, honing, super-finishing, fine-grinding, milling and the like operations which serve to change the shape of an article of metal or synthetic resin material in some desired way.

The power tool apparatus according to this aspect of the invention can be obtained by removing the impact-generating unit from the apparatus, thus leaving an apparatus comprising only the motor and the speed-reducing unit adapted for transmitting torque at a reduced speed to the tool socket means. However, it has been found that all of this hobby work can be carried out equally well with the impact-generating unit in place in the forward chamber of the enveloping shell.

When the impact-generating unit is removed from the forward sleeve chamber, it must, of course, be replaced by, for instance, the insert shaft means of Insert unit 8A.

According to the third aspect of the invention there are provided electrical switch means which comprise (1) first and second fixed contactor means adapted for being, at one end thereof, electrically conductively connected to electrical lead means constituting a first part of a path of electric current flow, these first and second contactor means having, at their other end, each a terminal portion bearing a contactable surface region;

(2) stationary mounting means adapted for holding the first and second fixed contactor means firmly in position in a mounting face thereof relative to a central switch axis normal to the said mounting face;

(3) a pivotable supporting member having at least one electrically insulating face, each such insulating face being spaced from a different contactable surface region of the first and second fixed contactor means;

(4) socket throughholes extending through the supporting member and opening out of an electrically insulating face thereof, and being adapted for receiving each a prong of an electric plug located in the said path of electric current flow;

(5) at least two shiftable contactor elements being mounted on the said electrically insulating face of the supporting member so as to be insulatedly spaced from each other and adapted for making contact with a prong of the said plug when the latter has been inserted in a corresponding one of the said throughholes;

(6) biassing means comprising first and second engagement means; with the first engagement means being mounted on the stationary mounting means, and the second engagement means being mounted on the supporting member and being engaged with one another in a manner such that the supporting member is pivotable through at least a small angle relative to the stationary mounting means between a neutral and at least one circuit-making position, and, when the supporting member is in an activated position, the biassing means urge the shiftable contactor means against the contactable surface regions of the fixed contactor terminal portions; and (7) a cap member comprising a cap end wall and a hull part upstanding axially therefrom about an inner face of the cap end wall; the inner face of the cap end wall being turned toward a face of the pivotable supporting member facing away from the electrically insulating face thereof.

In another embodiment of "on-off" and reversing electrical switch means according to the invention, the contactable surface regions of the stationary contactor means are located in the sidewalls of the terminal portions thereof, and the pair of shiftable contactor means are pin-shaped, each have a contact region and are mounted in the supporting member and extend substantially axially relative to the central switch axis from outside the outer face of the supporting member through the cap member and protrude from the inner face of the supporting member toward the stationary mounting means and into a substantially planar contact zone by a distance such as the extend parallel with the stationary contactor terminal portions by a sufficient length for the lateral contact regions of the shiftable contactor means to make contact with the contactable sidewall regions of the terminal portions in axially extending contact zones thereof, when the supporting member is angularly pivoted into either one of two limit positions relative to the stationary mounting means, while breaking contact when in at least one intermediary position between the limit positions;

the cap members having passage means for the introduction of a pair of lead means extending from a source of electric energy, into the interspace between the stationary mounting means and the inner face of the cap member end wall and into electrically conductive engagement with the pair of shiftable contactor means.

It is particularly important for a particularly superior functioning of the novel switch that the first engagement means of the biassing means are mounted on a front face of the stationary mounting means which front face is turned toward the supporting member, and that the second engagement means are mounted on the same face of the supporting member that bears the shiftable contactor elements, and that, while one of the said first and second engagement means protrudes from the respective face bearing the same into an interspace between the front face of the stationary mounting means and the contactor elements-bearing face of the supporting member, the other engagement means protrude from the other face far enough into the said interspace to be engagement with the first mentioned engagement means so that the supporting member is pivotable relatively to the mounting means.

The substantially planar contact zone in which the fronward ends of the fixed contactor means are located, extends through the above-mentioned interspace preferably substantially parallel with the said front face of the stationary mounting means; and the contact-making regions of the shiftable contactor elements on the supporting member must be movable into the said planar contact zone; or viceversa, i.e., the substantially planar contact zone extends substantially parallel with the contactors-bearing face of the supporting member, then the contactable regions of the fixed contactor means must extend into that contact zone.

In the last described embodiment of the switch means according to the invention, the shiftable contactors can be switched by a corresponding turn of the cap member to adopt at least three different positions; in a first "off" position, parts of the shiftable contactor means at the inner face of the cap member are out of contact with both the first and the second stationary contactor means, while in a second position, a first one of the shiftable contactor means makes contact with the first stationary contactor means lodged in the stationary mounting means, and the second shiftable contactor means makes contact with the second stationary contactor means also projecting from the stationary mounting means, thereby being capable of activating a motor for rotating a driving shaft thereof in a given direction of rotation, and, in a third position, the second one of the shiftable contactor means makes contact with the first stationary contactor means, and the first shiftable contactor means makes contact with the second stationary contactor means, thereby being capable of reversing the direction of rotation of the said motor and the said driving shaft, or of a corresponding machine.

Of two regions of the stationary and shiftable contactor means to be brought into contact in order to make circuit, which regions consist of the aforesaid lateral contact region and the contactable sidewall region, a first one preferably comprises inwardly crimped contact spring parts, and the other region is pin-shaped so as to be clampingly engagable by the first region.

BRIEF DESCRIPTION OF THE DRAWINGS

Further objects and advantages of the invention will become apparent from the following more detailed description thereof in connection with the accompanying drawings in which.

DETAILED DESCRIPTION OF THE EMBODIMENTS SHOWN IN THE DRAWINGS

Figure 1:
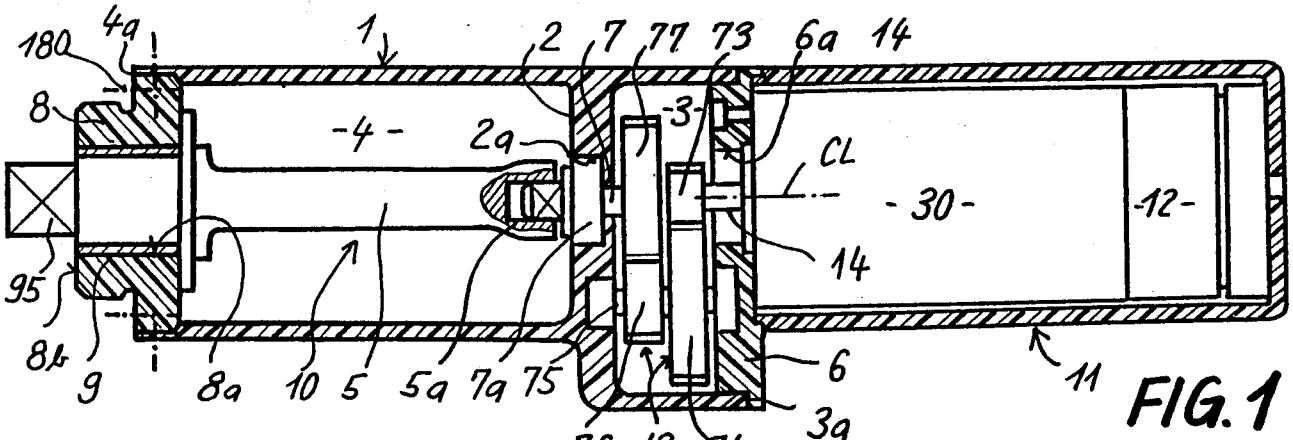
FIG. 1 is an axial sectional view of a schematical representation of a preferred embodiment of the electric rotary power tool apparatus according to the invention composed of three building blocks.

A first embodiment of the power tool apparatus according to the invention of particularly uncomplicated structure is shown in FIG. 1. This embodiment is built from an enveloping shell 1 having a central longitudinal axis CL and containing, integral with the shell 1, a transverse wall 2. This transverse wall 2 divides the shell interior into a rearward chamber 3, having an open rear end 3*a*, and a forward chamber 4 having an open front end 4*a* of the shell 1. In the rearward shell chamber 3 there is housed a speed-reducing unit 13 which will be described more in detail below. The open shell rear end 3*a* is closed by a second, transverse closing wall 6, which has an opening 6*a*. Likewise, the first transverse wall 2 has an opening 2*a* therein.

Between the two transverse, upright walls 2 and 6 enclosing the rearward shell chamber 3, the speed-reducing unit 13 is mounted as described hereinafter.

A driving shaft 14 extends through the wall opening 6*a* into the rearward shell chamber 3, and bears at its end a pinion 73; and a driven shaft 7 of the speed-reducing unit 13 extends through the wall opening 2*a* into the forward shell chamber 4.

The shell 1 and the speed-reducing unit 13 therein constitute a first building block of the power tool apparatus according to the invention. A second building block is constituted by a motor unit 11, to be described in detail hereinafter, which unit is mounted fixedly on the outside of the second transverse, closing wall 6.

A third building block comprises an insertable bearing-wall 8 which has a central opening 8*a* in which there is fitted a bearing 9. This bearing 9 is preferably a bronze bearing or constituted by a sintered bushing such as a carbide bearing or the like, in which there is supported a power-transmitting unit 10 which, in the simple construction of the embodiment of FIG. 1, is constituted solely by an intermediary shaft 5, one end *7a* of which is connected, for instance by a square head joint, for rotation with the driven shaft 7 near the transverse wall 2, and which extends through the forward shell chamber 3 and is supported in the bearing 9 in the bearing wall 8. From the latter the intermediary shaft 5 protrudes with its square-head front end *5a* to outside the bearing-wall 8. The latter, the bearing 9 and the shaft 5 thus can be assembled to constitute the entire third building block, and can be inserted into the forward shell chamber 3 via the open front end *4a* and can be guided in the bearing 9 so that the rearward end *7a* is brought automatically into engagement with the forward square-head end of the driven shaft 7 which end extends out of the opening *2a* into the forward shell chamber 4.

It is thus easy for an operator of the power tool apparatus according to the invention, for instance a construction worker doing heavy duty work, e.g. on a several storeys-high scaffolding, who holds the enveloping shell 1 and the motor unit 11 thereon with one hand, to remove the entire inset unit comprising the bearing-wall 8, by detaching the latter from the front end *4a* of the shell 1 with his other hand, depositing it in a kit box, taking out a different inset unit, which also comprises a bearing-wall 8, and reintroducing the new unit into the forward chamber 4 of the power tool apparatus via the open front end *4a* of the shell 1.

Fastening means holding the bearing wall 8 in the shell front end *4a* are of conventional snap-in, screw, or bolt-and-nut type and have been omitted from the figures of the drawing for the sake of clarity. Such fastening means are also used for mounting the motor unit on the transverse rear wall 6, and elsewhere in the apparatus as mentioned further below.

Figure 2:
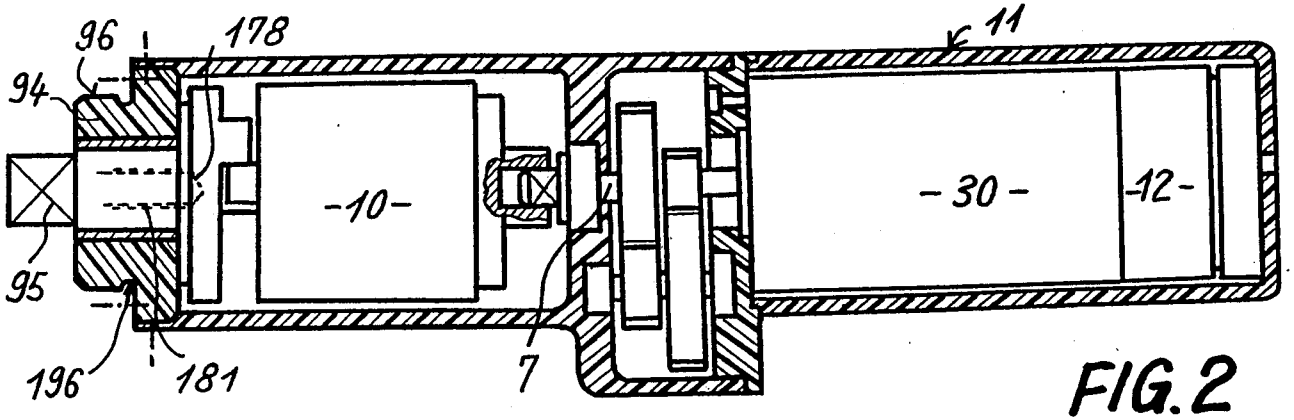
FIG. 2 is an axial sectional view of a similar embodiment, but with a different third building block, comprising a first embodiment of an impact unit.

In the embodiment shown in FIG. 2, parts identical with those of FIG. 1 bear the same reference numerals. The inset building block 10 is constituted by an impact-generating unit shown in more detail in FIGS. *2a* and *2b*.

There shall now be described in more detail the speed-reducing unit 13 and the impact-generating unit 10.

The following terms used in this description as well as in the appended claims such as "upper", "lower", "downward", etc. have reference to the respective positions as shown in the drawings. Moreover, the terms "front" and "forward", "rear" and "rearward" have reference to the apparatus as seen by the user holding it in hand, with the motor unit at the rearward and the inset unit at the front end.

The preferred type of speed-reducing unit 13 shown in FIG. 1 comprises a train of spur gears consisting of a small driving gear 73 mounted on the driving motor shaft 14 for rotation therewith. I have found it advantageous to use a gear having a diameter of 14 mm and bearing twelve cogs or teeth. This gear 73 engages another larger spur gear 74 which is mounted fixedly on a gear shaft 75 being rotatably mounted in upright casing walls 2 and 6. The spur gear 74 has advantageously a diameter of 44 mm and 42 cogs. On the same shaft 75 there is fixedly mounted, on the side of the gear 74 turned away from the motor unit 11, a smaller spur gear 76 having a diameter of 18 mm and 16 cogs. This gear 76 which rotates, of course, at the same speed as the gear 74 engages a larger spur gear 77 which is mounted on a driven shaft 7 having a separable forward extension *7a* constituting the aforesaid intermediary shaft and being rotatably supported in the frontal upright end wall 8 of the apparatus shell 1. The spur gear 77 has a diameter of 34 mm and bears 32 cogs. This results in a transmission ratio of the speed of the driving shaft 14 to that of the driven shaft of 7:1. The speed of the driven shaft is then 1957 r.p.m. if that of the driven shaft under full load is 13700 r.p.m.

The desired objects of the invention are also fulfilled if the following gear trains are used as speed-reducing unit 13; based on a full load motor speed of:

| Gear | Diameter (mm) | Cogs (number) | Speed ratio and Speed of driven shaft r.p.m. |
|---|---|---|---|
| 73 | 14 | 12 | |
| 74 | 39 | 36 | 12:1 |
| 76 | 14 | 12 | |
| 77 | 50 | 48 | ca. 1142 r.p.m. |
| 73 | 14 | 12 | |
| 74 | 42.3 | 40 | 10:1 |
| 76 | 14 | 12 | |
| 77 | 39 | 36 | ca. 1370 r.p.m. |

or similar transmission ratioes within the stated range.

The speed ratio of 7:1 is particularly preferred because it permits greater flexibility for use of the same apparatus as a hobby tool apparatus as shall be explained further below. Speed ratios above 12:1 and below 7:1 have been found unsatisfactory, because the driven shaft then either rotates too fast or too slow for the purpose set forth above, as shall be explained below.

In its forward portion the driven shaft 7 bears forward of its ball, roller or sintered metal bearing *7a* in upright wall 2 an impact-generating unit 10. (FIG. *2a*)

The impact-generating unit 10 comprises a claw coupling comprising two clutch halves of which the rearward half 79 is firmly mounted, for instance by means of a key *78c*, on the driven shaft *78a*, while the forward "hammer drum" 80 is mounted axially shiftable on the same shaft and is urged away from the rearward half 79 of the coupling by means of a strong axially acting pressure spring 81. The spring is housed in the hollow interior formed by cavities *79b* and *80b* in the adjacent portions of the two clutch halves 79 and 80 and has its one end supported against the inner face of the rear end wall *79a* of the clutch half 79 and the other spring end is supported against the inner face of the forward end wall *80a* of the clutch half 80.

The two clutch halves 79 and 80 remain in coupled engagement with each other at all times so as to rotate in unison about the shaft *78a* regardless of the position of the clutch half or "hammer drum" 80 on this shaft; to this end claws 83 of the rearward clutch half 79 engage claws 84 of the forward clutch half at all times.

Between the forward frontal face 82 of the forward clutch half 80 and the frontal upright wall 8 there is mounted, with its shaft 89, and impact anvil 85 bearing on its rearward disc face *85a* (see FIG. *2a*) a diametrically extending rib 86 having sloped flanks *86a* and *86b* whose angles of inclination converge from the disc face *85a* toward the clutch half 80. These flanks *86a* and *86b* can be abutted against by two noses or hammers 87 and 88 which protrude from the frontal face 82 of the clutch half 80 and are urged by the spring 81 toward the face *85a* of the impact anvil 85. Each of these two noses also has sloped flanks *87a*, *87b* and *88a*, *88b* on its axially extending lateral walls which sloped flanks abut against the sloped flanks 86*a*, 86*b* of the rib 86. The nose flanks 87*a*, 87*b* and 88*a*, 88*b* have been indicated by dashed lines in FIG. 2*b* because the cross sectional plane II-B—IIB extends through the untapered foot portions of the hammers 87 and 88, respectively, and the angles of inclination of flanks in each of these pairs converge toward the face 85*a*, of the impact anvil 85.

The impact disc shaft 89 is supported in a pressed-in gland or a ball roller, or sintered metal bush bearing 9 in the forward upright end wall 8 of the apparatus shell 1 and protrudes from the end wall 8 with a square head end 95. A tool socket, or for instance, a wrench having a suitable cavity, for instance of hexagonal cross section whose diameter corresponds to that of a screw, nut or bolt to be loosened or tightened, can be firmly attached to the square head end 95 for rotation with the latter.

The rearward end of the disc shaft 89 ends flush with the top face of the disc rib 86 and contains a cavity 89*a* preferably extending into the shaft zone inside the bearing 9, in which cavity 89*a* there is loosely supported the forward free end of the driven shaft 78*a*.

The operation of the impact unit 10 when loosening a screw nut or bolt having a right hand thread is the following: The tool is placed over the screw nut or bolt. Initially, the spring 81 shifts the loose clutch half 80 in forward direction and the noses 87 and 88 abut with their frontal faces against the rear disc face 85*a*. When the motor unit 11 is switched on, the driven shaft 7+5 rotates in the direction of the arrow L (FIG. 2*b*) together with the clutch half 79.

As the claws 79*b* and 80*b* remain in engagement with one another even when the clutch half 80 is shifted forward, the loosely mounted clutch half 80 is taken along and rotates in unison with the clutch half 79. Thereby, the clutch half nose 87 abuts with its leading sloped flank 87*a* (FIG. 2*b*) against the sloped flank 86*a* of the disc rib 86, whereby the former flank "climbs upward" on the latter, while the same occurs also with leading flank 88*a* of the clutch half nose 88 abutting against the sloped flank 86*b* of the rib 86. Thereby the loose hammer drum 80 is shifted slightly in rearward direction, with corresponding compression of the impact drum spring 81 until the hammers 87 and 88 can pass over the rib 86 of the impact disc 85. As rotation of the clutch halves 79 and 80 continues, the spring 81 urges them apart again so that the hammers 87 and 88 are shifted forward, together with their hammer drum 80, toward the impact disc 85. At each revolution of the driven shaft 7 the hammers 87 and 88 hit against the disc rib 86 until the screw nut or bolt has become loose enough, under these impacts occurring at a frequency of about 2000 per minute, to follow the rotary movement of the tool on the shaft 89, taking along the impact anvil 85. As soon as this occurs, the anvil 85 rotates in unison with the clutch halves 80 and 79, the impacts cease, and the nut or bolt can be completely removed.

Figure 2B:
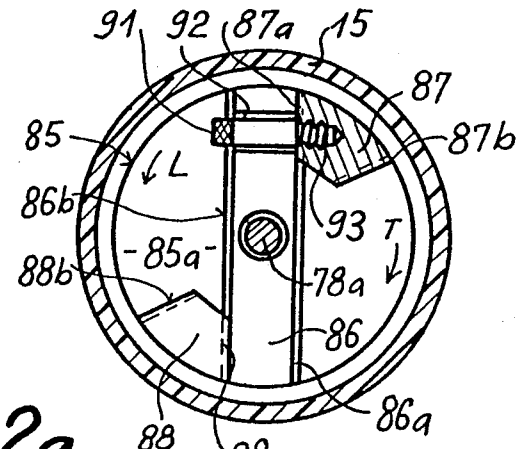
FIG. 2*b* is a cross sectional view of the same impact unit taken in a plane indicated by IIB—IIB in FIG. 2A.
Figure 2A:
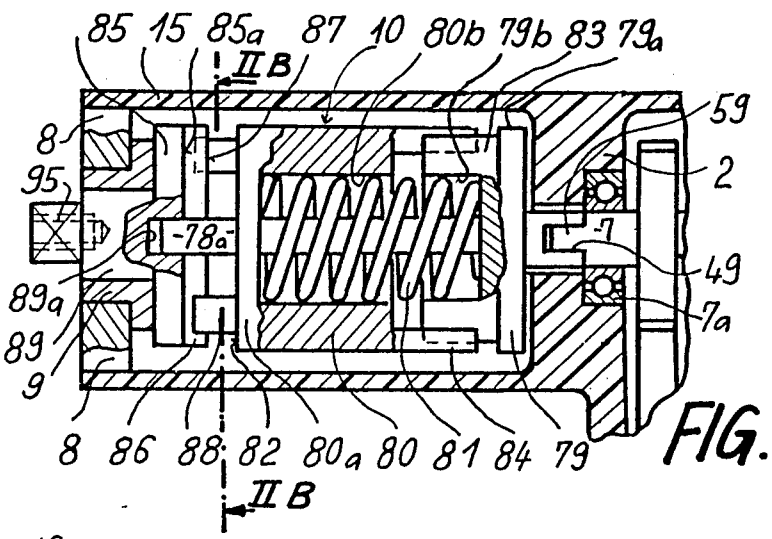
FIG. 2*a* is a detailed axial sectional view of the impact unit shown schematically in FIG. 2.

Operation in the opposite sense will lead to a tightening of the screw, nut or bolt (arrow T in FIG. 2*b*). If the motor runs at significantly less speed, or the speed reduction is greater than 12:1, e.g. if the motor speed under load drops to 10,000 r.p.m. or lower, for instance due to an automobile battery whose operational voltage has dropped to 10 volts or lower, or if the speed reduction ratio is 14:1 instead of 12:1, the corresponding lower number of impacts has been found insufficient to loosen a severely jammed or seized screw. A drop in the impact frequency will also prevent the hammers 87 and 88 from overcoming the bias of the spring 81.

Surprisingly, I have also found that a motor speed of, e.g. 35,000 r.p.m., corresponding to a driven shaft speed of 5000 r.p.m. when the speed reduction ratio is 7:1, or even of 25,000 r.p.m., if the speed reduction ratio is 5:1 thus yielding a driven shaft speed of about 5000 r.p.m., may also fail to loosen severely jammed screws. It appears that the impact exerted on the disc shaft 89 and on the tool thereon, will then be too weak, as the hammers 87 and 88 will skip over the disc rib 86 and will fail to produce a strong, abrupt impact. Moreover, at higher speeds due to a transmission ratio smaller than 7:1, the same load will impact too much braking power to the motor and too much lever force will be lost in the gear transmission.

When operating the motor with a 24 volt-automobile battery, a motor speed of 27,000 r.p.m. can be obtained. In this case the speed of the driven shaft 7 and the number of impacts on the disc rib 86 will rise to almost 4000 revolutions or impacts per minute, respectively. The same number of impacts can also be attained when the speed of the driven shaft 86 is 2000 r.p.m. and there are four noses provided, equidistantly distributed about the periphery of the frontal face 82 of the loose hammer drum 80. Depending on the degree of jamming or seizing of the screw, nut or bolt to be loosened, this higher number of impacts may work or fail.

Operations of the impact wrench shown in the embodiment of FIGS. 1 to 2*b* with direct current from a 12 Volt battery (operational voltage 10.5 to 14 volts) affording a motor speed of 13,750 to 15,000 r.p.m. and a transmission ratio of 7:1 affording a speed of the driven shaft 7 2000 r.p.m. and the same number of impacts per minute has been found to be most satisfactory.

Figure 3:
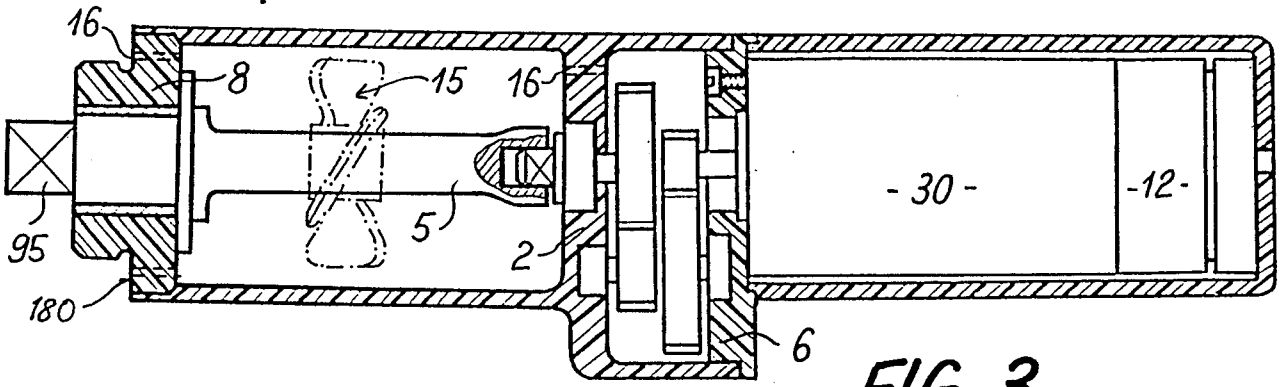
FIG. 3 is an axial sectional view of an embodiment similar to that shown in FIG. 1, but with a fan mounted on an insert shaft as part of the third building block.

In FIG. 3 there is shown, inserted in the same first building block as in FIGS. 1 and 2, a further embodiment of the third, i.e. the inset building block, which comprises the intermediate shaft 5 as well as a fan 15. During operation, this fan 15 can generate an air current through the entire interior of the enveloping shell 1; in this case air passages 16 are provided axially through the walls 2, 6 and 8 of the apparatus housing. Depending on the sense of rotation of the shaft 5, the fan 15 can blow air on to a tool attached to the square-head 95 of the driven shaft 5, or it can blow air into the motor unit 11 and cool the electrical motor therein.

The second rearward building block consists essentially of a motor unit 11 which comprises a motor and switch means 12 therefor.

The motor in the rearward building block is preferably an electric motor, and, for heavy duty work, when an automobile battery or portable nickel-cadmium battery are available, and also when the operator uses a kit according to the invention, which may contain the portable battery, an electric direct current motor has been found to be more satisfactory than any other type. The motor data given hereinafter by way of example are those of a motor which has proven to be most successful in heavy duty work as well as in all kinds of lighter work.

Figure 4:
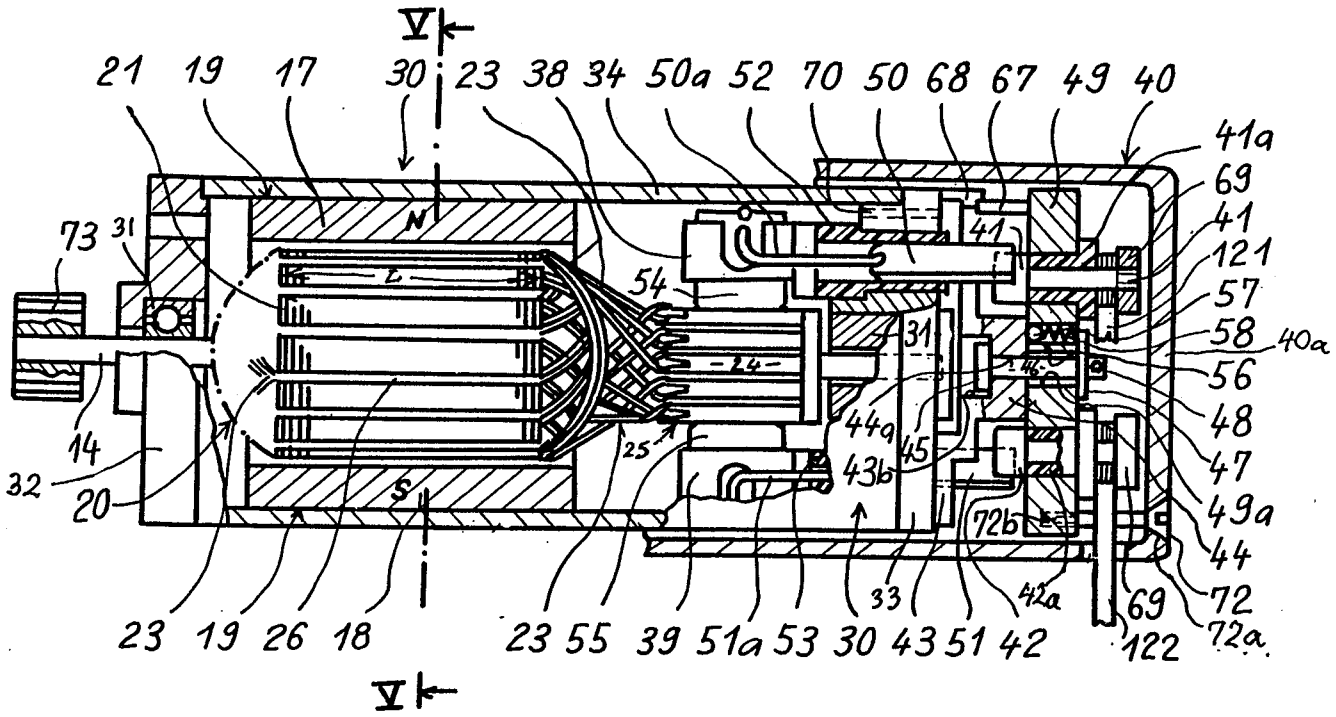
FIG. 4 illustrates, more in detail, a first embodiment of the motor unit constituting the second rearward building block, in a lateral view and partially in axial section.
Figure 5:
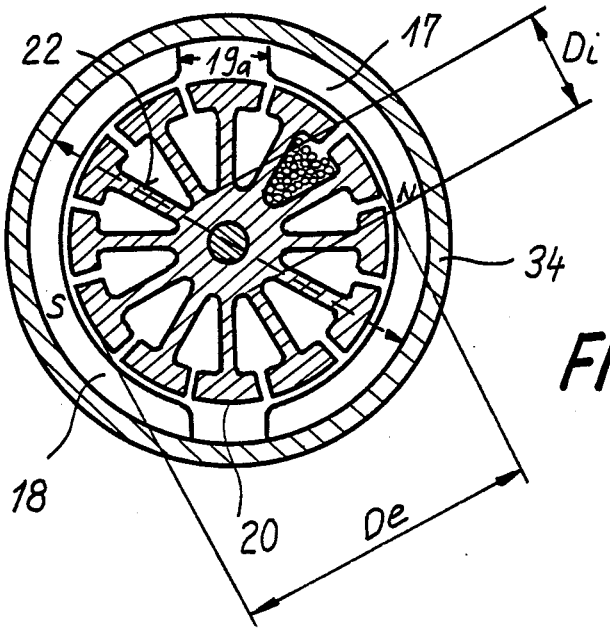
FIG. 5 is a cross sectional view of the same embodiment of the motor unit taken in a plane indicated by V—V in FIG. 4.

The motor unit 11 is shown in more detail in FIGS. 4 and 5. The unit comprises an electric D.C. motor which comprises a generally drum-shaped armature 20 composed of forty lamellae 21, each consisting of about 0.65 mm thick sheet iron plates having an external diameter $D_e$ of 32 mm, which are arranged in parallel to form a package having an overall length L of 26 mm (FIG. 4).

Each lamella 21 has in its outer annular zone twelve radial lamella cutouts 22, and the internal diameter $D_i$ of the lamella between the deepest ends of two diametrically opposite cutouts 22 is 16.7 mm. The lamellae 21 in the stack thereof forming the armature 20 are superimposed upon each other so that the cutouts register with one another and form twelve axially extending channels 26 in the external surface of the armature 20. Each of these channels houses portions, shown in cross section only in a single cutout 22 for the sake of clarity, of a hard copper wire 23. This copper wire has a diameter of 0.56 mm. Windings of this copper wire are wound about the armature in loops, so that 32 wire portions fill each of the channels 26, each loop consisting of two such portions and having a length of about 60 to 70 mm, i.e. a bit more than double the length of the armature. The wire windings are formed by pieces of wire having a length of about one meter, so that each such piece of wire can be wound in about sixteen loops from the rear end of the motor about the armature 20 through the channels 26 of the latter. The two free ends of each piece of wire are soldered to different collector segments 24 of a commutator 25 which is mounted fixedly on a driving shaft 14 in common with the armature 20 for rotation in unison therewith.

As there are twelve pieces of wire having a total of 24 free wire ends, twelve collector segments 24 are provided in the commutator 25, the whole constituting a two-pole drum-winding having a total length of twelve meters of wire of about 12 meters. The total number of wire portions in the twelve channels which should be shown in FIG. 5 would be 384.

The driving shaft 14 is supported in roller or bronze bearings 31 which are mounted respectively in the frontal end wall 32 and the rear end wall 33 of a motor housing 30. The latter is in turn held firmly in the upright wall 6 of the apparatus shell 1, as shown in FIG. 1.

The housing further comprises a cylindrical hull 34 which bears in its interior firmly attached to its inside wall the north pole shoe 17 and the south pole shoe 18 of a permanent magnet 19 of magnetic iron which have a length, in axial direction, of 31 mm and a radial thickness of 5.5 mm. The general arrangement of permanent magnet and armature is well known and illustrated in FIG. 150 of chapter "Gleichstrommaschinen" in "Elektrotechnik" by A. Däschler, a text-book published in 1968 by Verlag Aargauer Tagblatt AG in Aarau, Switzerland. However, as indicated in FIG. 152 of the same publication, the armature diameter is expected to be about 600 mm instead of the 32 mm of our novel D.C. motor. While the D.C. motor, according to FIG. 152 of the Däschler-textbook affords 280 kilowatts (kW) at 1470 r.p.m., our motor affords under load 0.6 kW at about 3700 r.p.m.

Electric motors of electric power-operated impact wrenches which are presently available in the market and are capable of loosening jammed or seized nuts or threaded bolts of automobile wheels for the purpose of changing automobile tires must derive their power from an electric main, e.g. of 220 to 240 volts of A.C.

Several impact wrenches of this type have been described under the heading "Schlagschrauber" in the publication "Bosch Elektrowerkzeuge, Programm 1980/81 in Aug. 1980, by Robert Bosch GmbH, D-7022 Leinfelden-Echterdingen, Germany. Depending on the size of the bolts to be loosened, e.g. of 16 mm diameter for passenger car wheels, the motor operates under full load with a speed of 1000 r.p.m., it has a power input of 320 Watt (about 1.5 Amp.) and a power output of 165 Watt and a tightening torque of 180 Newtonmeters (Nm), the wrench has a weight of 3 kilograms.

For heavier bolts of 22 mm diameter, the wrench is equipped with a motor operating at 725 r.p.m. under full load, with a power input of 420 Watt, (about 1.9 amperes) a power output of 200 Watt, and a tightening torque of 300 Nm; the wrench weights about 5.3 kg.

Screws having a diameter of 27 mm can be loosened with a wrench whose motor penetrates at a speed of 540 r.p.m. under full load, with an input of 620 Watt (2.8 amperes), an output of 360 Watt, and a tightening torque of 800 Nm; this wrench weights 8.3 kg.

In contrast thereto, the above-described electric motor in our preferred embodiment operates at a speed under full load of 2000 to 2800 r.p.m., with a power input of about 300 to 450 Watt (25 to 40 amperes) and a power output of about 250 Watt, and a loosening torque up to 800 Nm (25 amperes and higher); the apparatus has a weight of maximally 3 kg, and even less, while it is fed by a D.C. of 12 volts (operational voltage of about 10 to 14 volts) as supplied by a common automobile battery. When connected to a heavy automobile battery of 24 volts, it operates under full load with a speed of 4000 r.p.m.

A speed is measured under full load when the tool socket is momentarily blocked and the impact mass hits upon the impact abutment in the impact unit. In this case the speed of Motor A drops from the idling speed of 15,000 r.p.m. to a speed under full load of 2800 r.p.m. corresponding to a speed of the driven shaft with continuous impacts of 400 r.p.m. when the Motor A is used in an impact wrench according to the invention having a speed reduction ratio of 7:1, and to a speed of 235 r.p.m. when the impact wrench has a speed reduction ratio of 235 r.p.m. The motor then draws a current of about 75 amperes from the 12 volt battery, i.e. a power of about 800 watts, when loosening excessively tightened bolts or nuts of automobile wheels. The power input required by the motor when the tool socket and the driven shaft idle and the motor shaft rotates at a speed of 14,000 r.p.m., is about 18 watt, corresponding to about 7 amperes when the battery has a potential of about 11.4 volts, when the speed reducing ratio in the impact wrench is 12:1. When this ratio is 7:1 the idling speed of the motor shaft was found to be 12,600 r.p.m., the power consumption was 74 watts, corresponding 6.4 amperes of current drawn from a battery having a potential of 11.56 volts.

Old batteries having no longer the full potential of 12 volts were used in order to test the capabilities of the impact wrench according to the invention under less than optimal conditions.

In the following table there are given data for two preferred embodiments A and B of the electric motor to be used in the power tool apparatus of the invention:

| | | Motor A (in mm) | Motor B |
|---|---|---|---|
| (1) | Length of straight winding portions on armature | 26.7 | 50 |
| | diameter of armature with winding | 32.2 | 32.2 |
| (2) | diameter of armature wire | 0.56 | 0.72 |
| (3) | length of each magnet pole shoe (N or S) | 31 | 64 |
| (4) | thickness of magnet pole shoe (N or S) | 5.5 | 5.5 |
| (5) | internal width 19a between | 33 | 33 |

-continued

| | | Motor A | Motor B |
|---|---|---|---|
| | | (in mm) | |
| | magnet pole shoes | | |
| (6) | diameter of motor shaft | 5.0 | 5.0 |
| (7) | diameter of commutator | 15.0 | 15.0 |
| (8) | diameter of assembled armature and two pole shoes (Dm) | 43 | 43 |
| | | (r.p.m) | |
| (9) | motor shaft idling speed connected to 12 Volt battery | 15000 | 8000 |
| (10) | motor shaft idling speed connected to 24 Volt battery | 28000 | 15000 |
| | with 12:1 transmission: | | |
| (11) | bolt loosening strength connected to 12 Volt battery | 250 Nm* | ≦60 Nm* |
| (12) | bolt loosening strength connected to 24 Volt battery | >300 Nm* | >250 Nm* |
| | *wrench width over flats of 16 mm. | | |
| | wrench width over flats of 27 mm. | ≧400 Nm | ≧300 Nm |

The fully satisfactory results obtained with the preferred embodiment of the power wrench according to the invention are particularly unexpected as it would have been obvious to provide a slower motor of less full load speed and higher power input and output the severer the jamming or seizing of the screw to be loosened (see the Bosch motors described above).

I have discovered unexpectedly that the opposite is true and that a "weaker" motor operating at higher speed under full load can do the same job successfully even though it is fed with direct electric current of low voltage, e.g., 12 or 24 volts of an automobile battery.

The small size, low weight and high speed of the above-described motor used in the preferred impact wrench according to the invention is comparable only to those of compressed air motors as they are known to be used in Atlas Copco wrenches (see the publication "Schrauber" by Atlas Copco Aktiebolag, Nacka, Sweden, in Nov. 1971). However, these wrenches are destined only for screws having a diameter of about 5 to 8 mm, and are therefore unsuitable for tightening or loosening screws or bolts of automobile wheels. The same is true for the Mitsubishi hobby impact tool apparatus, in particular drills, driven by small motors as described hereinbefore.

In attaining the objects of the invention I have found the following features described hereinafter to be also critical, i.e. the high speed of the weaker motor is only one of several criteria I had to observe in achieving the above-stated main object.

Thus, I have found that the speed reduction ratio of the driving to the driven shaft in the speed reducing unit is highly critical in order to achieve the object of loosening severely jammed or seized screws, bolts or nuts of the type used for mounting automobile wheels on their hubs. This speed reduction ratio should be in the range of from about 12:1 to about 7:1, the ratio of 7:1 being the preferred one when the apparatus is operated with D.C. drawn from a 12 volt-automobile battery.

In order to obtain a particularly satisfactory operation of the embodiment of the power tool apparatus shown in FIGS. 1 to 3, it has also been found very advantageous to avoid voltage losses by providing novel on-off and reversing switch means 12.

Figure 6:
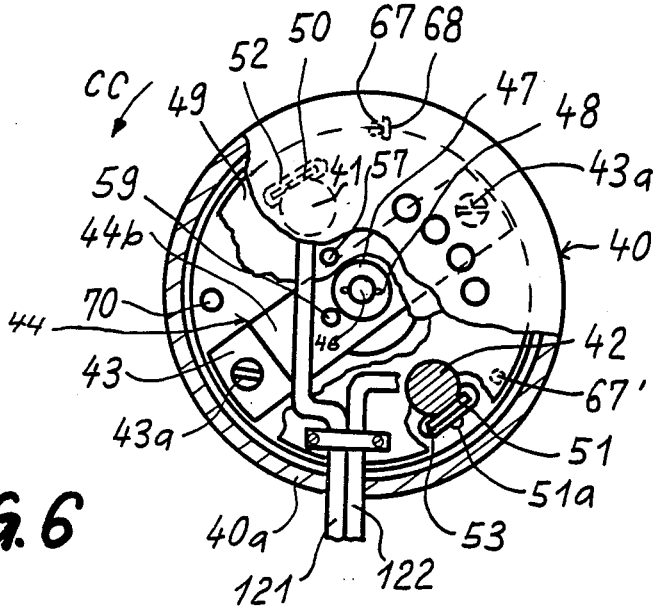
FIG. 6 is a partially cross sectional rear view of the rearward end of the motor unit embodiment shown in FIG. 4, comprising a first embodiment of switch means.

A preferred embodiment of such switch means 12 is illustrated in FIGS. 4 and 6. The leads 121 and 122 from the +pole and the −pole, respectively, of a 12 Volt- or 24 Volt-automobile battery are connected to two contactor pins 41 and 42 which are mounted inside a rotatable switch cap 40 on a pins-supporting disc 49, being electrically insulated against the latter by insulating jacket 41*a* and 42*a*. The disc 49 is firmly connected with the switch cap 40, for rotation therewith, by means of one or several connecting flat-head screw bolts 72 inserted through a hole 72*a* in the cap bottom wall 40*a* and screwed into a threaded bore 72*b* in the supporting disc 49. The disc 49 is rotatably mounted n a bridge member 43 which is fastened by means of screws 43*a* on the outside face of the rear end wall 33 of the motor housing 30. The bridge member 43 has on its side facing away from the rear end wall 33 an outwardly projecting raised central bridge portion 44 and a central bore 44*a* therein which registers with the central bore 49*a* of the supporting disc 43 and opens at its forward end in the cavity 43*b* in the face of the bridge portion 44 turned toward the motor housing rear end wall 33. A setbolt 46 having a larger diameter bolt head 45, which rests in the cavity 43*b* extends through the central bores 44*a* and 49*a* and protrudes from the rearward face of the supporting disc 49 where it is fastened by means of a washer 47 and cotter pin 48, thus serving as a shaft about which the pins-supporting disc 49 can be rotated by turning the switch cap 40.

The pins-supporting disc 49 has a further axial bore 56 which opens out of the inward face of the disc 49 where the latter abuts against the rearward face 44*b* of the raised bridge portion 44. A resting ball 57 is lodged in the bore 56 and is urged into contact with the rearward bridge portion face 44*b* by means of a pressure spring 58 also lodged in the bore 56 and being supported at its other end on the underside of the washer 47.

Owing to the above-described arrangement, the switch cap 40 is held rotatably at the rear end of the motor unit 11, with the cap side wall 40*a* enclosing the rearward portion of the motor housing 30. Rotation of the cap 40 about the cap shaft 46 is limited by the stop 67 mounted on the forward face of the pins-supporting disc 49 which abuts, in the position shown in FIGS. 4 and 6 against a first counter stop 68, in which position pins 41 and 42 are electrically conductive contact, respectively, with two contactor blades 50 and 51 which are mounted, adjustably in axial direction, in blade bearing means 52 and 53, respectively, which are of electrically insulating material. The contactor blades 50 and 51 are in turn electrically conductively connected via litzes (leads) 50*a* and 51*a* with the commutator brushes 54 and 55, respectively. These brushes 54 and 55 are held in brush holders 38 and 39 of electrically insulating material and slide over the collector segments 24 of the electro motor.

Direct electric current is supplied to the motor 12 from leads 121 and 122 which have their one ends connected to the +pole and −pole, respectively, of a direct electric current source, in particular an automobile battery of 12 volts (FIG. 43), while their other ends are fastened, respectively, to the threaded rearward ends of the contactor pins 41 and 42 by means of fastening nuts 69 and 69*a*.

In the position of the switch cap 40 illustrated in FIGS. 4 and 6 the collector segments 24 thus receive direct electric current from lead 121 via contactor pin 41, contactor blade 50 and collector brush 54, on the one hand, and from lead 122 via contactor pin 42, contactor blade 51 and collector brush 55, while upon turning the switch cap by 90° counterclockwise (when looking at the rear end 33 of the motor housing 30 in axial direction), i.e., in the sense indicated by the arrow CC in FIG. 6. When the switch cap 40 has been turned through an angle of 90°, the bore 56 of the supporting disc 49 registers with a small recess or indentation 59 in the rearward bridge portion face 44*b*, which recess is large enough to receive half of the ball 57 therein, thus providing a light arresting position for the switch cap 40, indicating that the switch is in OFF-position.

By further rotating the switch cap 40 counterclockwise, the ball 57 is forced out of the recess 59 against the bias of spring 58 until the stop 67 on the disc 49 abuts against a second counter stop 68*a* thus assuming the position indicated by 67' in FIG. 6.

This position of the switch cap 40, the position of the contactor pins 41 and 42 is exchanged, pin 41 now making contact with the contactor blade 51, while the pin 42 makes contact with the contactor blade 50. The motor thus receives direct electric current flowing in the opposite direction from the leads 121 and 122 connected to the automobile battery and will accordingly rotate in the opposite sense.

This means that, if the motor turned clockwise, corresponding to the sense of the arrow T in FIG. 2*b* when the contactor pins and blades made contact in the first described manner, then, with contact established in the last described manner, the motor of unit 11 will reversed, i.e. it will rotate counterclockwise, in the sense of arrow L in FIG. 2*b*.

The embodiment of an impact wrench apparatus shown in FIGS. 1 to 6 can be easily converted to a hobby tool. This conversion is possible in two ways. According to one mode of conversion, a connecting bolt 91 can be inserted through a transverse bore 92 in the rib 86 of the impact disc 85, which bolt 91 will protrude into a corresponding bore 93 in at least one of the noses 87 and 88, thus eliminating the impact effect and causing the impact disc 85 to rotate in unison with the clutch halves 79 and 80.

Figure 7:
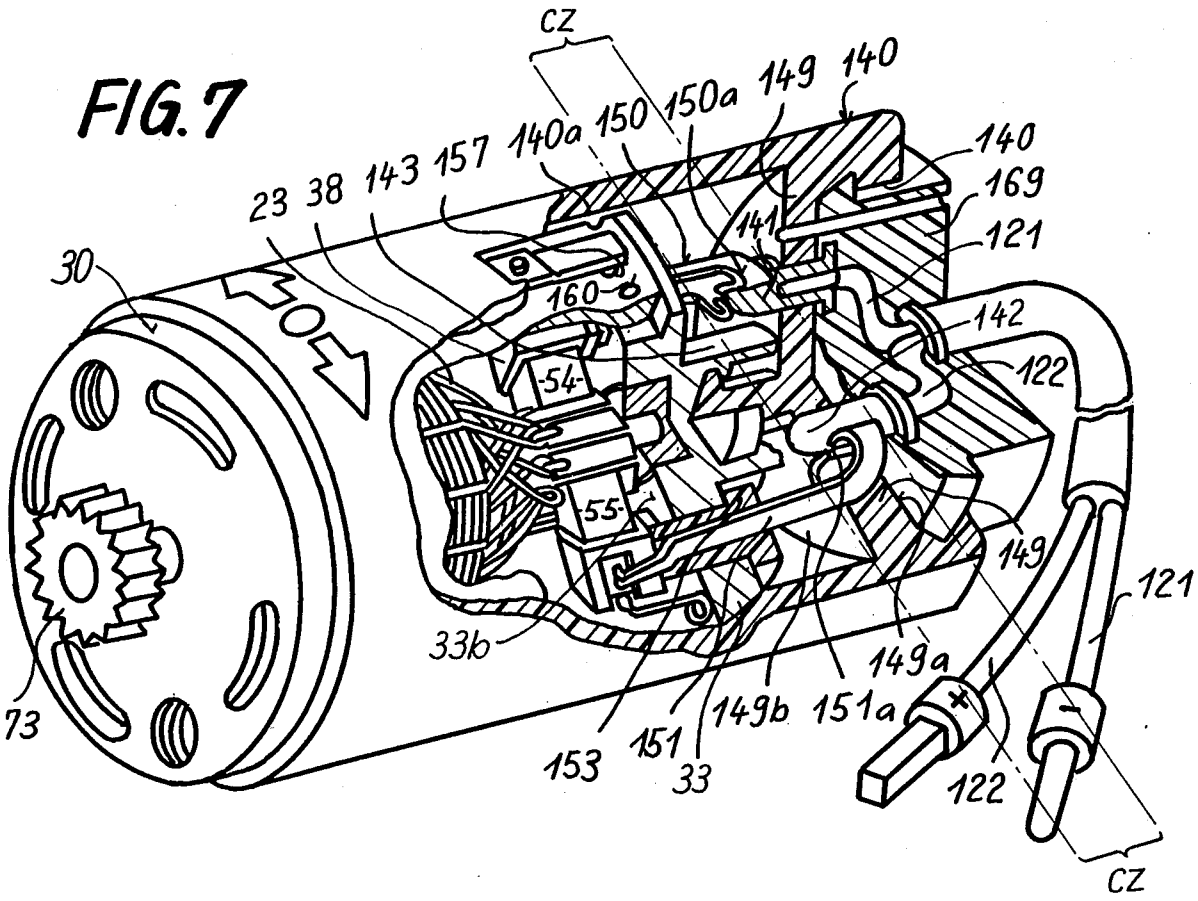
FIG. 7 is a partially cut-open perspective view of the motor unit constituting the second building block, with a second embodiment of novel switch means therein.
Figure 8:
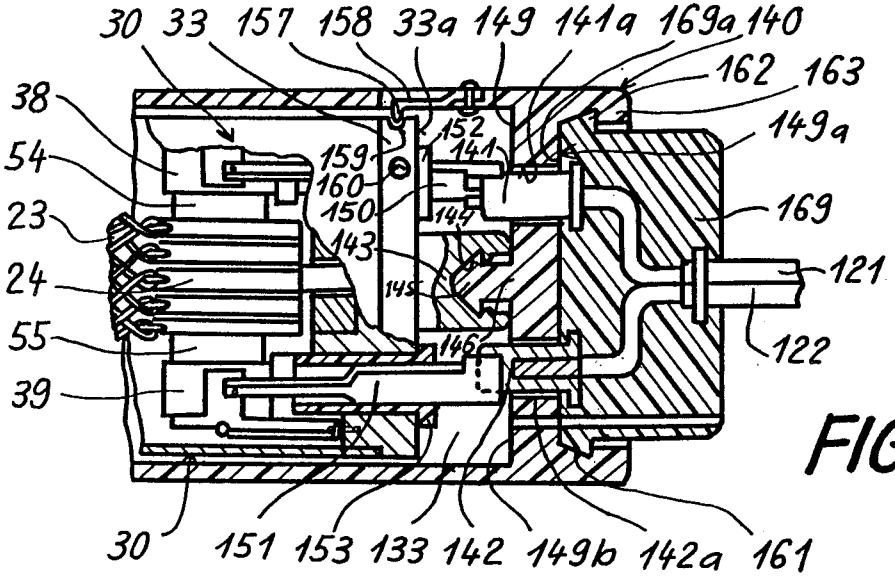
FIG. 8 is a partially axially sectional view of the rear portion of the embodiment of the motor unit and switch means shown in FIG. 7.

In the embodiment of the motor and the on-off and reversing switch means shown in FIGS. 7 and 8, like parts having identical functions are designated by like numerals as in the preceding Figures.

This embodiment is characterized by a particularly simple, sturdy arrangement of the current-conducting parts of the rear portion of the armature and of the switch means. The cap member 140 has a closing wall 149 extending radially with regard to the rotor axis, a lateral cylindrical wall 140*a* and, on the outer face 149*a* of the closing wall 149, a peripheral, inwardly crimped rim 163 surrounding a cavity 161 the bottom of which is constitutes by the outer face 149*a* of the closing wall 149 and which cavity 161 is open toward the outside at the rear end of the power tool apparatus.

The closing wall 149 bears on its inner face 149*b* a central pin 146 having a larger diameter head 145 which is snapped into a corresponding snap-in recess 144 in a socket 143, whereby the cap member 140 is supported for pivotal displacement on the rear end wall 33 of the motor housing 30. The socket 143 protrudes axially from the rearward face 33*a* of the motor housing end wall 33. In the rear end wall 33 there are mounted, in diametrical arrangement with regard to the rotor axis, and in blade bearing sleeves 152 and 153, two contactor blades 150 and 151 which extend into the interior of the motor housing 30 and are electrically conductively connected to the brushes 54 and 55, respectively.

In this embodiment, the use of litzes 50*a* and 51*a* has thus been eliminated, thereby reducing the possibility of power losses. At their free ends the contactor blades 150 and 151 bear resilient, inwardly crimped contact spring parts 150*a* and 151*a* which are contacted by contactor pins 141 and 142 which are snugly lodged in corresponding bores or ducts 141*a* and 142*a*, respectively, in the closing wall 149 of the cap member 140 and protrude through this closing wall 149 axially into the interspace 133 between the inner face 149*b* of the closing cap wall 149 and the rearward face 33*a* of the rearward wall 33. The contactor pins 141 and 142 are firmly embedded in a plug body 169 and protrude from the inner face 169*a* thereof, while leads 121 and 122, which are connectable to the minus and plus terminals of an automobile battery, have their opposite ends likewise embedded in the plug body 169 and have their insulation-free cable ends firmly inserted in the contactor pins 141 and 142 respectively. The plug body 169 is inserted firmly into the cavity 161 and abuts with its frontal face 169*a* against the outer face 149*a* of the closing cap wall 149. The plug body 169 is held firmly in the cavity 161 by means of a laterally projecting annular flange part 162 about the frontal face 169*a* of the plug body 169, which flange 162 is snapped-in and held in position by the inwardly projecting annular rim 163 of the cap member 140.

In the periphery of the motor housing rear end wall 33 there is provided a flat indentation 159 which is engaged by a spring tip 157 being mounted at the free end of a small blade spring 158 which urges the tip 157 into engagement with the indentation 159.

This engagement of the spring tip 157 of the indentation 159 is shown in FIGS. 7 and 8. In this position of all parts of the motor housing rear end wall and switch means relative to each other, the motor will run in a determined sense of rotation, when the leads 121 and 122 are pluged into the minus and plus pole, respectively, of the automobile battery. Current will then flow from the lead 121 through the contactor pin 141, the contactor blade 151 and the brush 54 to the collector segments 24 and the windings 23 of the armature 20.

When the cap member 140 together with the plug body 169 therein and together with the contactor pins 141 and 142 is pivoted about the axis of its central pivot 146 in the socket 143, the spring tip 157 leaves the indentation 159 and rotation of the cap member 140 is continued until the spring tip 157 enters a next following indentation 160. This may be noticed by a click audible to the user. In this position, both contactor pins 141 and 142 have broken contact with contactor blades 150 and 151, and no current will flow from the automobile battery to the motor.

Upon further pivoting of the cap member 140 about the axis of its central pin 146 in the same sense of rotation, the spring tip 157 will slide on the peripheral surface of the motor housing rear end wall 33 until it enters, preferably with a click into a third indentation (not shown) in which the contactor pin 141 makes contact with a contactor blade 151, while the contactor pin 142 makes contact with the contactor blade 150. Thereby, current will flow from the negative pole of the automobile battery to the brush 55 and from this brush into the windings 23 of the armature 20 and from the brush 54 back to the plus pole of the battery wire lead 122 and the motor will run in the reverse sense of rotation.

A third embodiment of the switch means according to the invention is illustrated schematically in FIGS. 9 to 13.

On the rear end wall 33 of the motor housing there is mounted rigidly by conventional fastening means (not shown) a stationary mounting or switch base member 60, of electrically insulating material, which is cup-shaped having a cavity 60*a* from the center of the bottom face 60*b* of which there projects axially a stem 61. Stationary contactors 50 and 51 are mounted in the base member 60 and connected by litzes 50*a* and 51*a* with the motor brushes in the same manner as in the preceding switch embodiments.

A supporting member 26 which bears the shiftable contactor elements 35 and 36 is pivotally mounted on the stem 61 which latter projects into a dome part 27 of the supporting member 26 by way of a central dome opening. A screw 29 is inserted into a threaded axial bore of the stem 61 and holds a biassing spring 64 in place on the stem. This spring 64 urges the supporting member 26 toward the base member 60.

Preferably, the entire supporting member 26 or at least its annular inside face 26*a* is of electrically insulating material. On this inside face 26*a*, there are mounted the two shiftable contactor elements 35 and 36, each of which is of curved configuration, covering an arc of about 120 degrees about a central switch axis CS which is normal to the base member 60 and the supporting member 26.

A cap member 40 covers the entire switch and has a cap end wall 40*a* on which the supporting member 26 is mounted fixedly. Turning the cap member by hand will therefore also turn the supporting member 26 relative to the base member 60 about the pivot constituted by the stem 61.

Such pivoting of the cap member 40 and the supporting member 26 therein about a small angle of a few, e.g. 15 to 45 degrees to the left (arrow L) will cause a contact face 35*a* at the one end of the contactor member 35 to slide on to the frontal face 51*b* of the fixed contactor 51, while the diagonally opposite contact face 36*a* will slide on to the frontal face 50*b* of the fixed contactor 50. The biassing spring 28 pulls the two faces 35*a* and 36*a* against the faces 51*b* and 50*b*, respectively, thereby causing a secure electrical circuit to be made from a source of direct electrical current via the plug 100 whose prongs 97 and 98 are inserted into throughholes 101 and 102 in the cap member 40 and throughholes 101*a* and 102*a* in the supporting member 26 which throughholes register respectively with one another. The prongs 97 and 99 make electrical contact with the corresponding cavities or bores 35*a* and 36*a* in the central regions of arc-shaped contactor elements 35 and 36.

Figure 14:
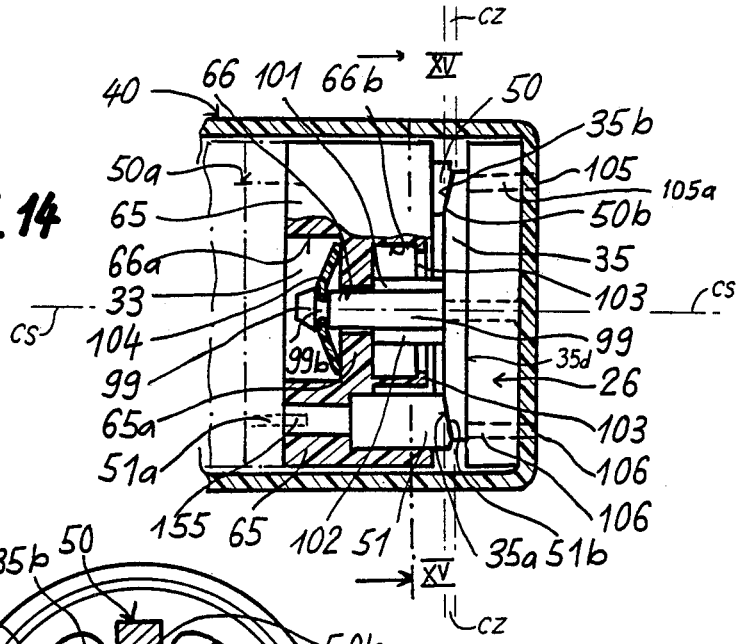
FIG. 14 is an axial-sectional view of a second embodiment of the biassing means in the switch means according to the invention.

In order to facilitate sliding of the ends of contact elements 35 and 36 on to the contact faces 50*b* and 51*b*, respectively, one or both of the contact faces of the shiftable and fixed contactors can be slanted or have beveled or curbed edges, as indicated in FIG. 14.

When the cap member 40 and supporting member 26 are pivoted together to the right (arrow R in FIGS. 10 and 12), the contactor elements 35 and 36 will slide with their opposite ends 35*b* and 36*a*, respectively, on to the contact faces 50*b* and 51*b*, and the motor of the motor unit 11 will run in the opposite sense of rotation.

After contact has been made by the switch means 12 in the above-described manner and the operator ceases turning the cap member 40, a restoring spring 28 (FIGS. 9 and 10), whose legs 28*a* and 28*b* abut against stops 62 and 63 which are integral with the base member 60, will come into action. When the cap member 40 is pivoted to the left, the spring leg 28*a* of the restoring coil spring 28 is held in place by the stop 62 and the spring 28 is tensioned. When turning force on the cap member 40 ceases, the restoring spring 28 will pull the cap member 40 back from the activating position shown in FIG. 12 to the neutral position shown in FIG. 10.

The above-described biassing and restoring spring means can also be replaced by other, less expensive means. Thus, in FIG. 14, the biassing of the supporting member 26 toward the base member 65 is achieved by a plate spring 104 which is lodged in an inner cavity 66*a*, opening toward the motor housing end wall 33, of the base member 65, and is fastened at its center to the free end of a stem 99 of hexagonal, elongated cross sectional area. This stem 99 projects from the center of the supporting member 26 and extends through a recess 66*b* in the face of the base member 65, which is turned toward the supporting member 26, and through a central throughhole 66 in a separating wall part 65*a* of the base member 65, which wall part 65*a* separates the cavity 66*a* from the recess 66*b*.

Figure 15:
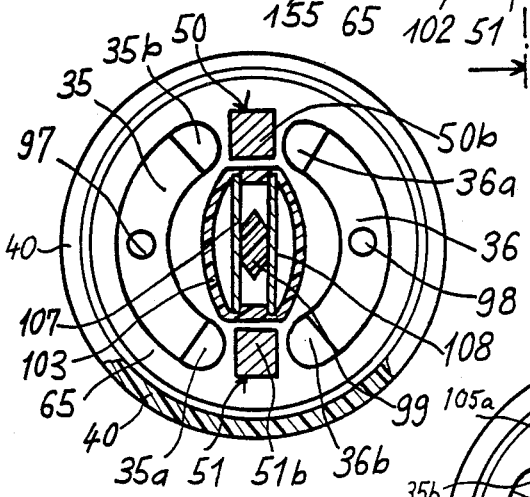
FIG. 15 is a cross-sectional view of the embodiment of switch means and biassing means taken in a plane indicated by XV—XV in FIG. 14, with the parts in neutral position.
Figure 16:
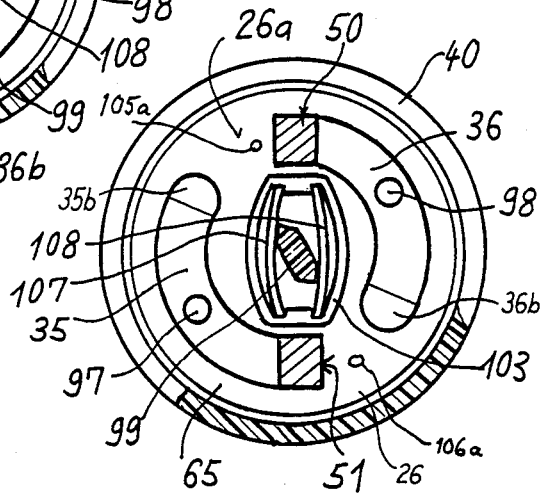
FIG. 16 is a view similar to that of FIG. 15, with the parts in an activating position.

The hexagonal column representing the stem 99 comprises two opposite broad flanks, and adjoining the two long edges of each of these broad flanks are two pairs of narrow flanks of which each pair has a common edge. The distance between the two broad flanks is considerably shorter than the distances between diagonally opposite narrow flanks. Two elastically resilient blades 107 and 108, made for instance from pieces of flat clock-spring steel, lie flat and straight against the two broad flanks of the stem 99. When the cap member 40 and together therewith the supporting member 26 and the stem 99 thereon are turned by an angle of, for instance, 30°, as shown in FIG. 16, the blades 107 and 108 are spread apart and when turning force is no longer applied to the cap member 40, the steel blades 107 and 108 will restore the stem 99 and the other parts connected therewith to the neutral position shown in FIG. 15.

Figure 18:
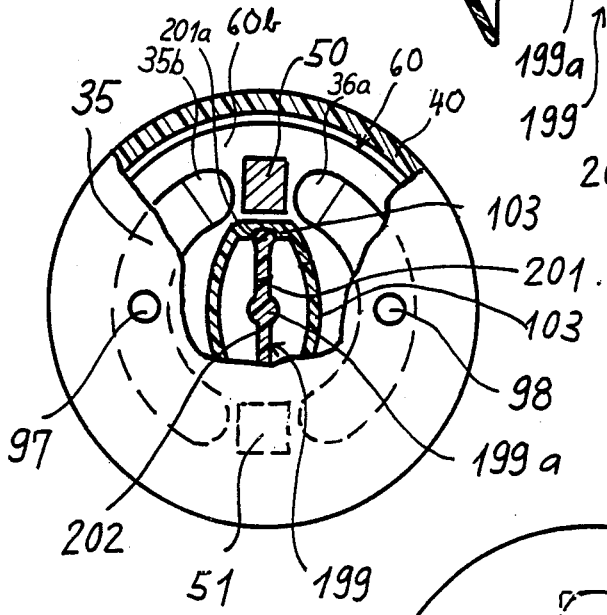
FIG. 18 is a partly cut-away rear end view similar to that of FIG. 15, but with the third embodiment of the biassing means shown in FIG. 17 in neutral position.
Figure 17:
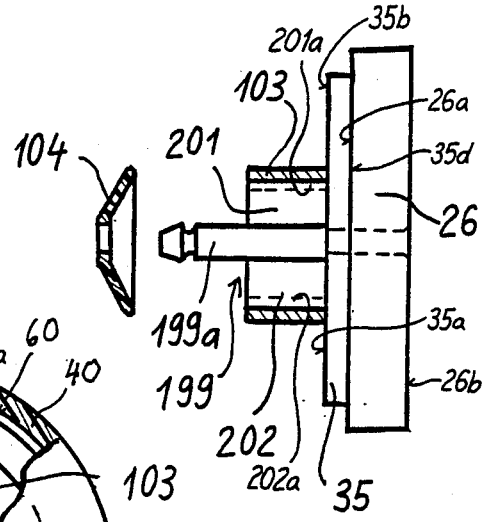
FIG. 17 is an exploded view of the parts constituting a third embodiment of the biassing means in the third embodiment of the switch means according to the invention.
Figure 19:
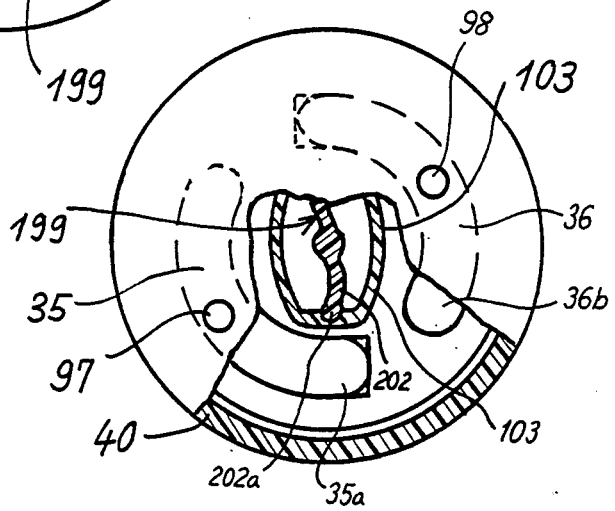
FIG. 19 is a view similar to FIG. 18, but with the parts in an activating position.

In the embodiment of restoring means shown in FIGS. 17 to 19, the restoring elastically resilient element is an elongated plate member 199 which is integral with the supporting member 26. The plate member 199 is mounted at at the longitudinal edges of two elastically deformable portions 201 and 202 thereof in a rigid cage 103 which is in turn mounted stationary on the face 60*b*, turned toward the supporting member 26, of a base member 60.

Turning of the cap member 40 into an activating position will cause a deformation of the plate member 199, as shown in FIG. 19, generating retoring bias therein while release of the cap member will cause the plate member 199 to straighten out and to return the entire assembly of the shiftable contactor elements 35 and 36, the supporting member 26 and the cap member 40, to the neutral circuit-breaking position shown in FIG. 18.

Figure 13:
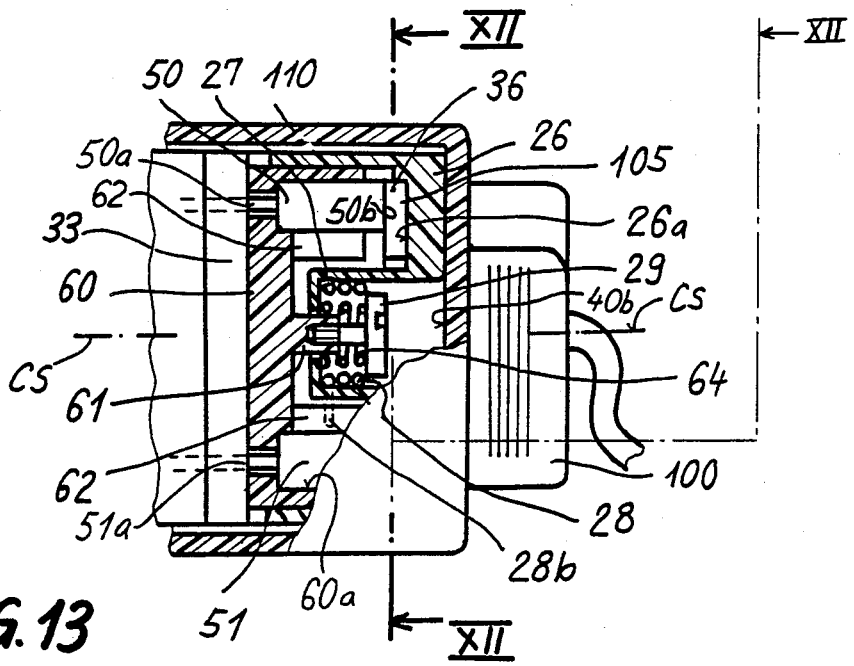
FIG. 13 is a view similar to that of FIG. 11, showing, in axial section, a first embodiment of biassing means in the same embodiment of the switch means as shown in FIGS. 9 to 11.
Figure 12:
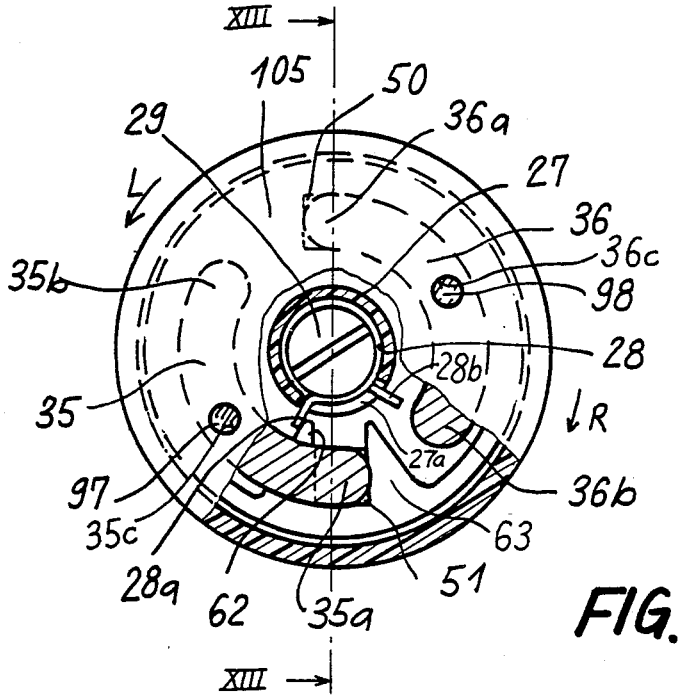
FIG. 12 is a view similar to FIG. 10, but with the parts in an activating position.

Instead of activating the switch means by having the supporting member 26 mounted fast in the cap member 40 for rotation therewith, a cap member 110 can also be connected rigidly with the rearward wall 6 of the first building block, and the supporting member can be loosely surrounted by the cap member 110 and be mounted pivotably on the protruding base member sleeve (61) as shown in FIG. 13.

Figure 9:
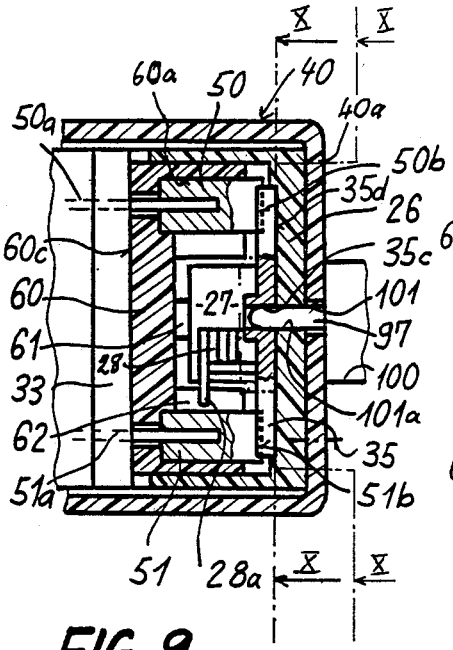
FIG. 9 is an axially sectional view of a third embodiment of the switch means according to the invention, taken in a plane indicated by IX—IX in FIG. 10, infra; with the parts in neutral circuit-breaking position.
Figure 11:
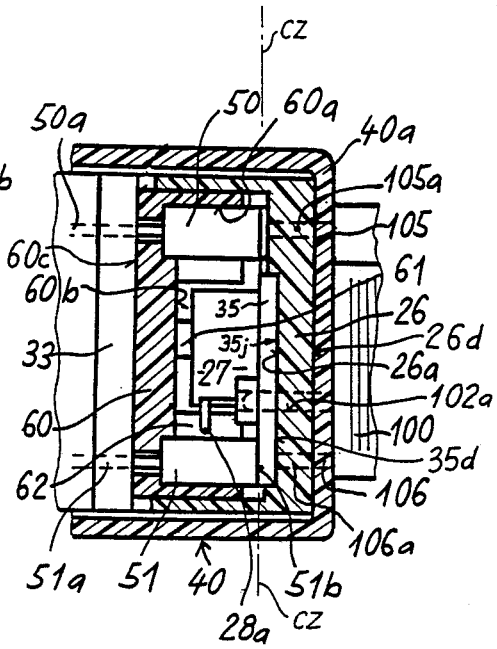
FIG. 11 is a view similar to that of FIG. 9, but with the parts in an activating position.
Figure 10:
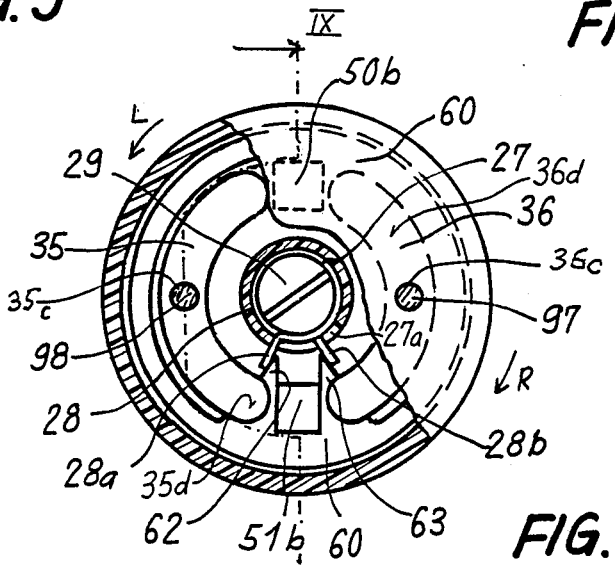
FIG. 10 is a rearward end view, partially cut open, of the embodiment of the novel switch means shown in FIG. 1.

In this case turning of the supporting member 26 and activation of the electrical circuit is effected with the aid of a push button lever 109 which protrudes tangentially from a window 112 in the stationary cap member 110 and is integral with the rim 111 of the supporting member 26 (see also FIG. 9). The lever 109 protrudes through a window 112 in the stationary cap member 110. This push-button equipped embodiment of the switch means according to the invention is shown in FIGS. 20 to 23.

Figure 21:
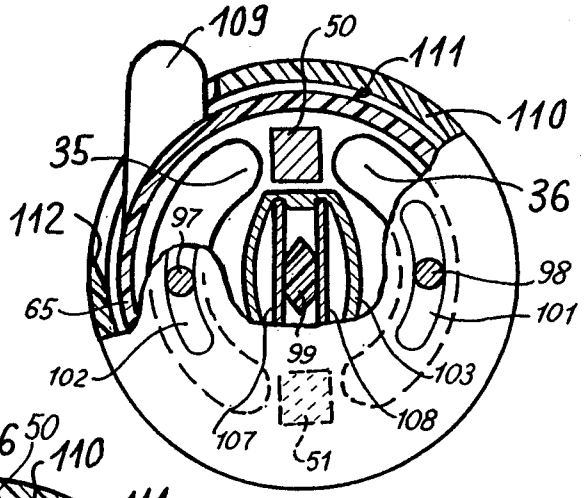
FIG. 21 is a cross sectional view, taken in a plane indicated by XXI—XXI in FIG. 20, with the parts in neutral position.
Figure 22:
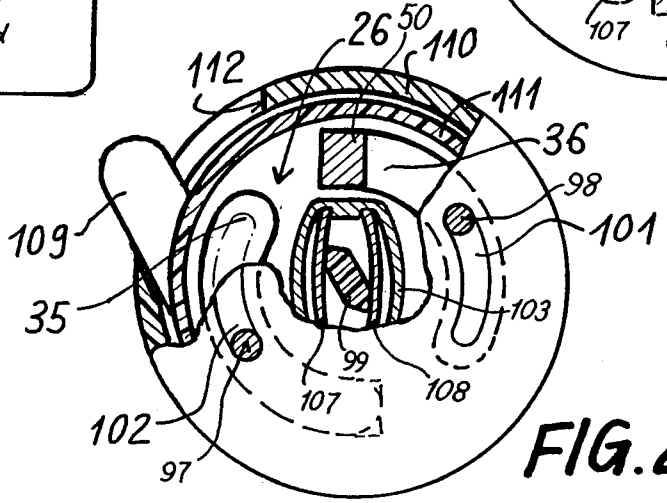
FIG. 22 is a view similar to that of FIG. 21, but with the parts in an activating position.
Figure 20:
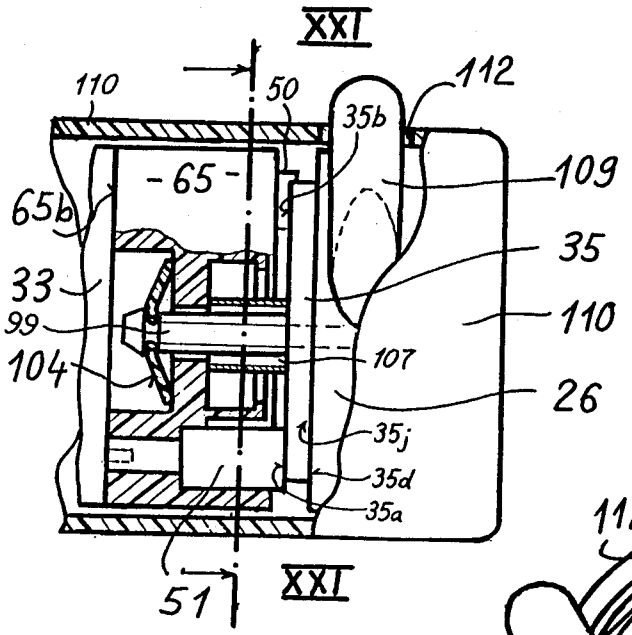
FIG. 20 is an axial-sectional view of a fourth embodiment of the switch means according to the invention.
Figure 23:
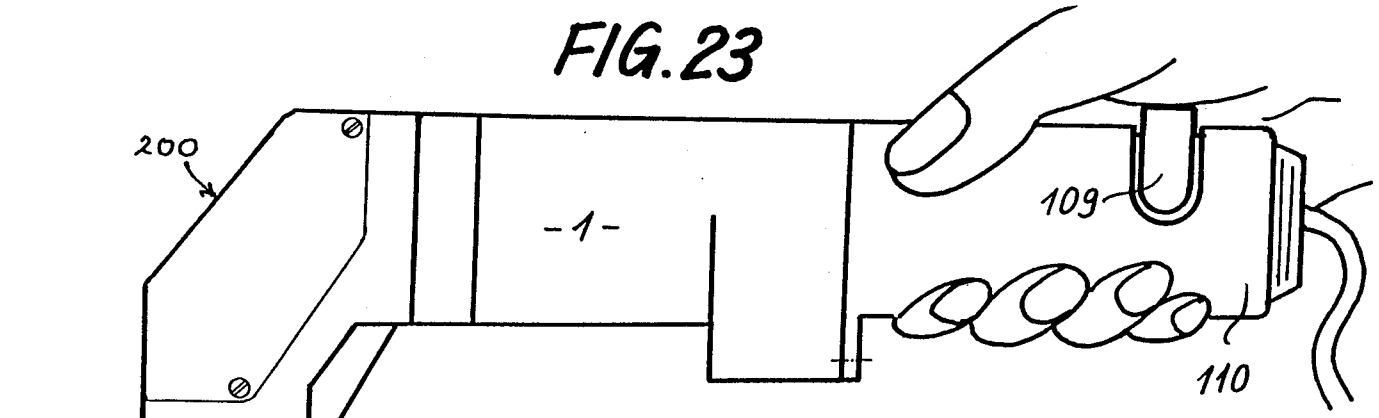
FIG. 23 is a lateral view of an embodiment of a power tool apparatus according to the invention held by an operator's hand activating an embodiment of the switch means as shown in FIGS. 20 to 22.
Figure 26:
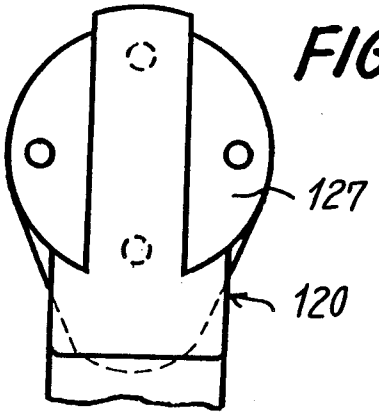
FIG. 26 is a rear end view of the upper rearward part of the handle unit shown in FIG. 24.

FIGS. 20 and 21 thereof show the switch means in neutral position, FIG. 22 shows the push-button lever 109 in downwardly swivelled position, whereby the supporting member has been turned by an angle of about 30 degrees, and FIG. 23 shows how the operator can depress the lever 109 with the palm of his hand while holding the power tool apparatus according to the invention.

Figure 24:
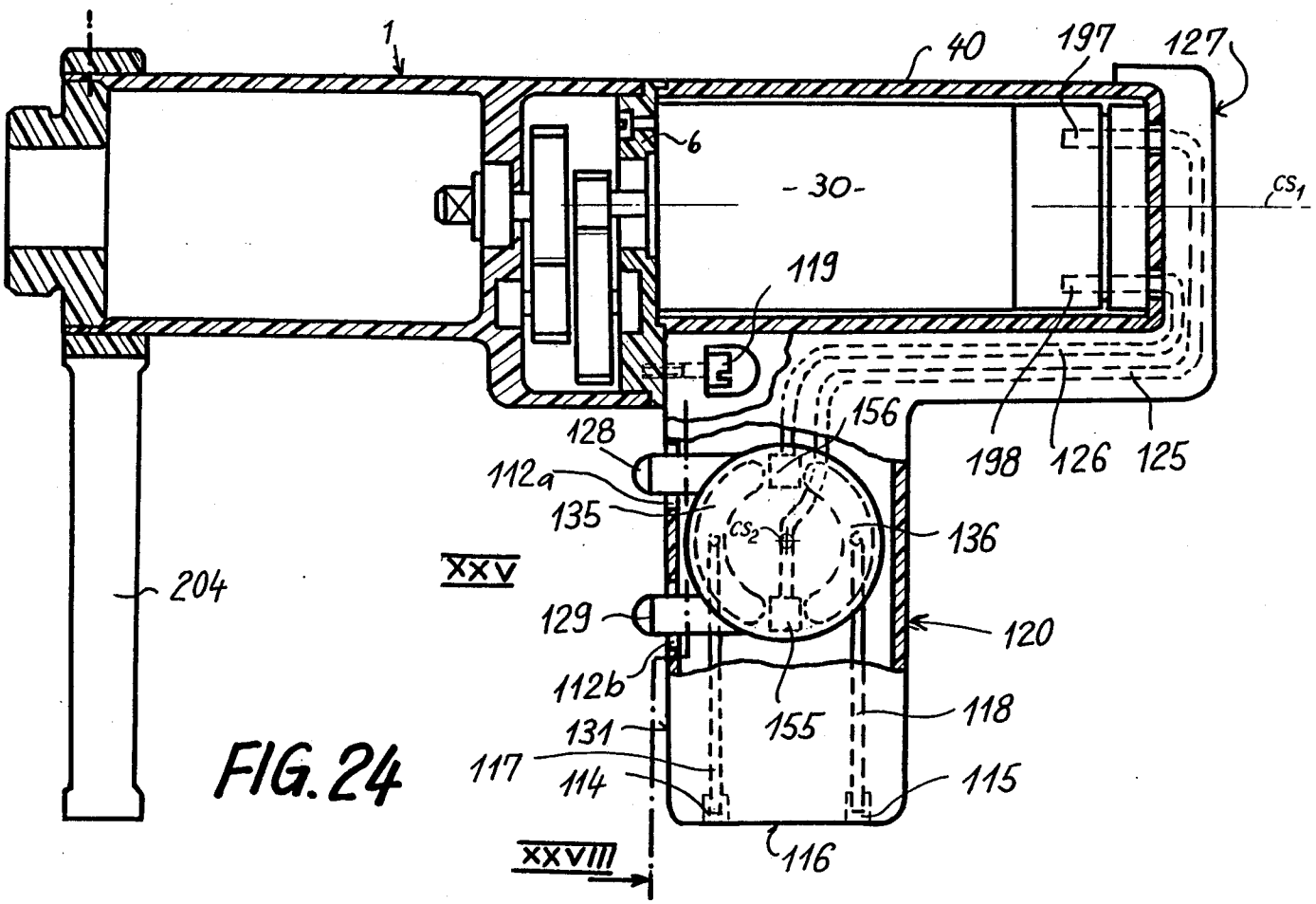
FIG. 24 shows in axial-sectional view the same embodiment of the power tool apparatus shown in FIG. 1, but without inserted shaft means of the third insert unit (8C) in said building block, and, attached to the first building block, a first embodiment of a handle unit according to the invention.

In a kit according to the invention, there can be provided, as an auxiliary item, a handle part, a preferred embodiment of which is designated by the reference number 120 in FIG. 24.

This handle part 120 can be fastened rigidly, e.g. by screw bolts 119, on the outside of the rear end wall 6 of the first building block. A grip member 204 can also be clamped on to the shell 1.

Figure 25:
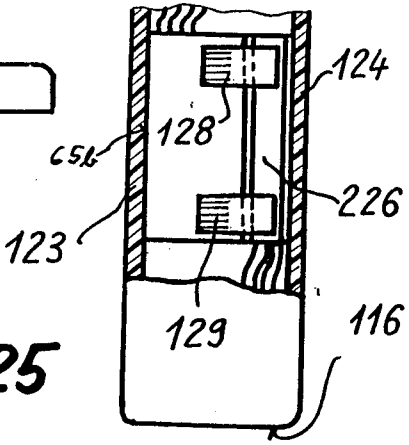
FIG. 25 is a partial cross sectional view of the handle unit taken in a plane indicated by XXV—XXV in FIG. 24.

Between opposite sidewalls 123 and 124 (FIGS. 25) there is mounted a switch of the type illustrated in FIGS. 20 to 21. However, the base member 65 is mounted, with its outer face **65*b*, not on the outside face of the motor housing end wall 33, but instead on the inner surface of the sidewall 123, and the supporting member 226 is pivotally mounted on the base member 65 in the same manner as illustrated in the case of supporting member 26 in FIG. 14, with the outer face of the supporting member 226 extending parallel with, but slightly spaced from the inner surface of the opposite sidewall 124 of the handle part 120**.

The prongs 97 and 98 of the plug 100 can be inserted in corresponding sockets 114 and 115 at the downward end 116 of the handle part 120 which sockets are connected via leads 117 and 118 with the shiftable connector elements 135 and 136.

The fixed contactors 155 and 156 are connected by means of electrical leads 125 and 126 which extend up to a rear extension 127 of the handle part 120 to surround the rearward end of the cap member 40 and bear at their other ends prongs 197 and 198. These prongs are inserted into the throughholes 105, **105*a* and 106, 106*a* in the cap member 40 and the supporting member 26, respectively, (FIG. 14) and are long enough to make firm contact with the frontal contact faces 50*b* and 51*b* of the stationary contactors 50 and 51, thereby holding the cap member 40 and the supporting member 26 stationary relative to the stationary base member 65**.

The supporting member 226 bears tangentially disposed actuating levers 128 and 129 which protrude from the interior of the handle part 120 through windows **112*a* and 112*b* in a front wall 131 of the handle part 120**.

Depression of one of the actuating levers energizes the motor in the housing 30 in one sense of rotation, depression of the other lever energizes the motor for rotation in the opposite sense.

The reference numeral 200 designates a rotary cutting tool attached to the front end of the power tool apparatus, which tool will be described further below in connection with FIG. 37.

In FIGS. 27 to 30 there are illustrated two versions of a simple mechanism for turning the cap member 40 when a different embodiment of the handle part is used, and thereby activating the switch means 12 inside the cap member, while no secondary switch means are provided in the handle part 130. This handle part does not comprise a rearward extension 127.

Figure 27:
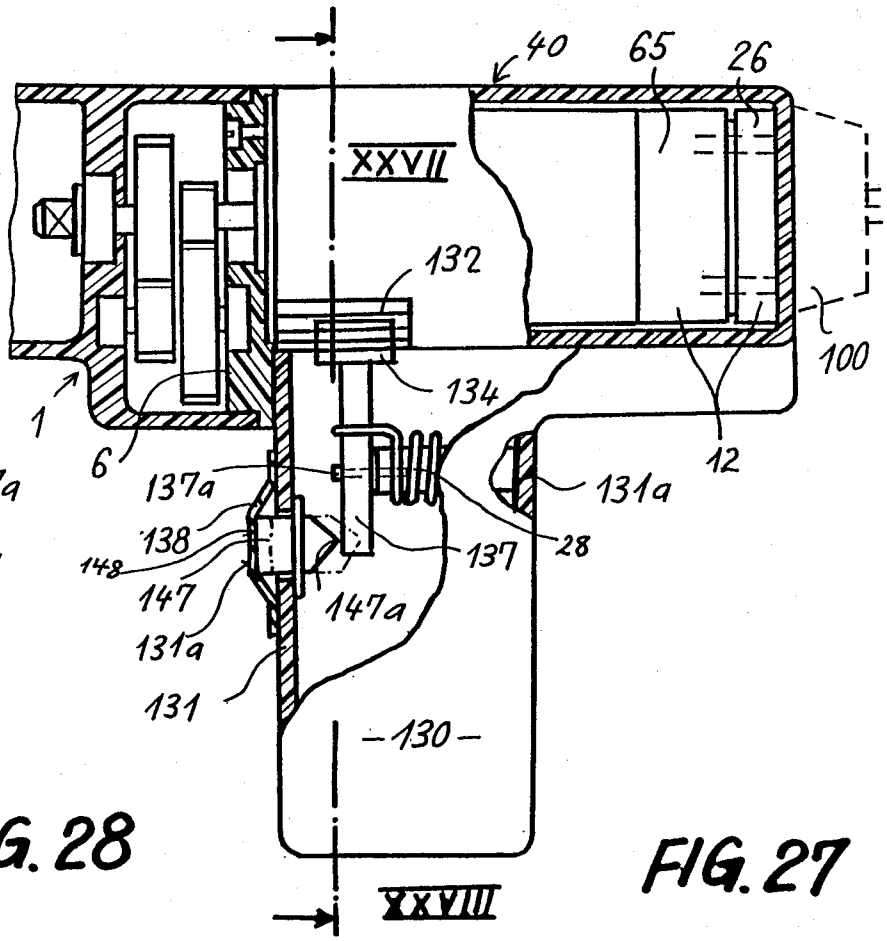
FIG. 27 is a side view of the embodiment of the power tool apparatus shown in FIG. 1, but bearing a second embodiment of the handle unit attached thereto as well as modified switch-actuating means therein.
Figure 28:
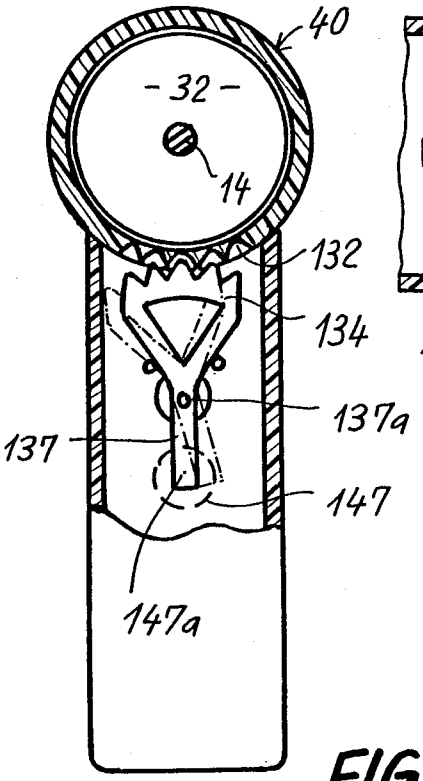
FIG. 28 is a cross sectional view of the last-mentioned power tool apparatus and handle unit, taken in a plane indicated by XXVIII—XXVIII in FIG. 30, infra.

In the actuating mechanism illustrated in FIGS. 27 and 28, the handle part 130 is attached firmly to the rear end wall 6 of the enveloping shell 1 of the first building block and supports the second building block in a manner such that the cap member 40 can be turned by the operator relative to the shell 1 and handle part 130, in order to actuate the switch means 12 comprising preferably the parts illustrated in FIG. 14.

The cap member 130 bears at its underside a curved, peripherally extending rack 132 in which a pawl 134 is engaged. The pawl 134 is pivotally mounted on a pivot pin **137*a* fixed in the rearwall 131*a* of the handle part 130**.

In the front wall 131, there is mounted an actuating peg 147 protruding via an opening **131*a* with its conically pointed end 147*a* inwardly into contact with the front side of a rod-shaped extension 137 of the pawl 134. The flat opposite face 148 of the peg 147 is mounted on the inside of a deformable circular membrane 138 whose periphery is firmly attached to the outside of the front wall 131 of the handle part 130**.

When an operator holding the handle part depresses with one finger the actuating peg 147 inwardly and deflects it slightly either to the right or to the left, as desired, the conical surface of the peg 147 about its conically pointed tip **147*a* will press the pawl-rod 137 correspondingly to one side and the pawl 134 will cause the cap member 40 to turn correspondingly and cause the switch means 12 to make circuit. In FIG. 28 the actuating peg 147 has been slightly deflected to the right while depressing it, so that the pawl 134 is also swivelled to the right and causes the cap member 40 to turn in the sense of the arrow L shown in FIG. 12**.

Restoring means can be provided in the handle part 130 and comprise a restoring spring 28 similar to that shown in FIG. 13.

Figure 29:
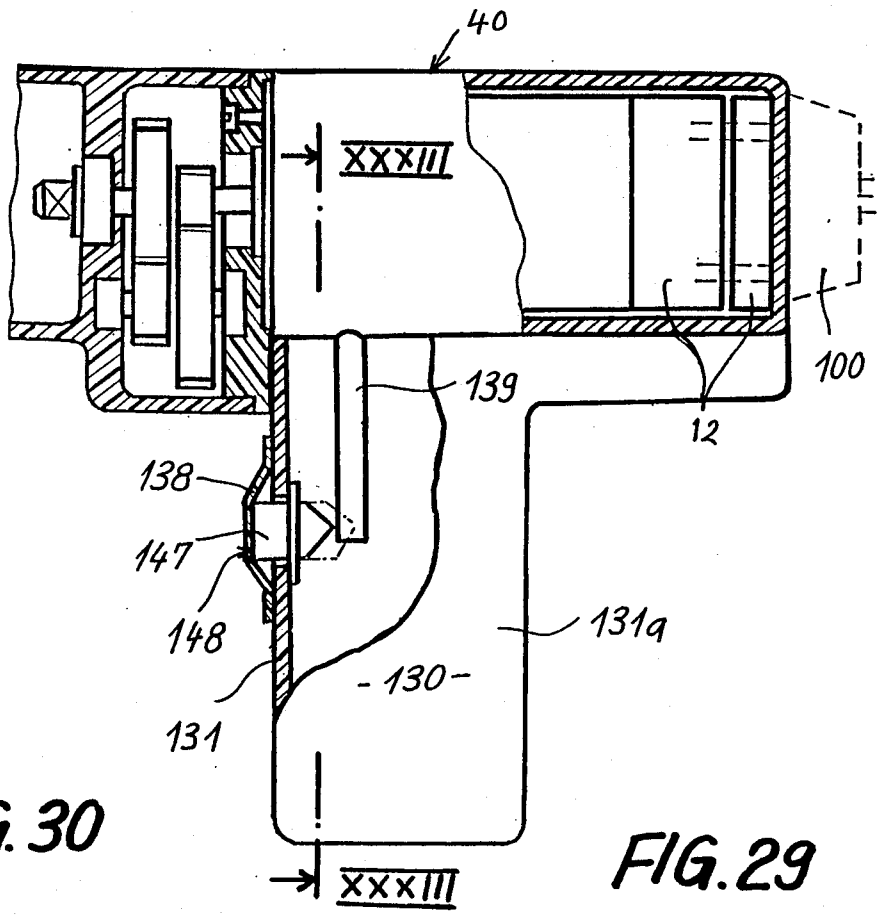
FIG. 29 is a side view of the embodiment of the power tool apparatus shown in FIG. 1, but bearing a third embodiment of the handle unit and switch actuating means therein.
Figure 30:
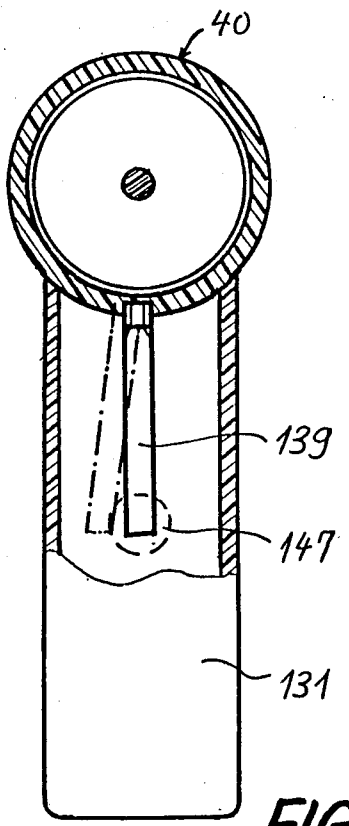
FIG. 30 is a cross-sectional view of the embodiment of the last-mentioned power tool apparatus taken in a plane indicated by XXX—XXX in FIG. 22.

In the simpler actuating mechanism shown in FIGS. 29 and 30, the cap member 40 bears firmly attached on its underside a rod 139 which projects downwardly into the interior of the handle part 130. The same peg-and-membrane mechanism as used in the embodiment of FIGS. 27 and 28 is also applied in this case. Restoring spring means are provided in the same manner as in the switch means illustrated in FIGS. 9 to 13 or 14 to 19 and urge the cap member 40 toward neutral position.

Figure 32:
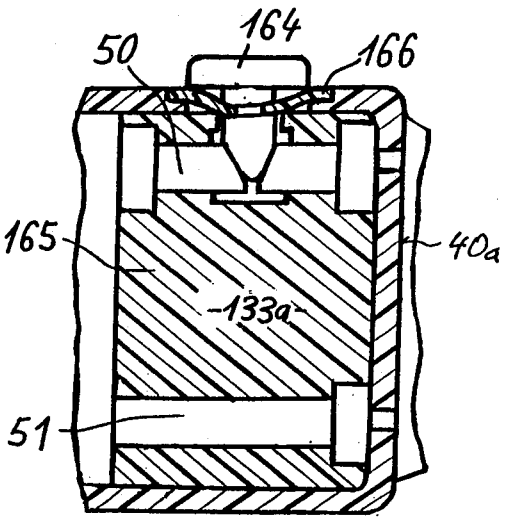
FIG. 32 is a view similar to FIG. 31, but with the parts in an activating position.
Figure 31:
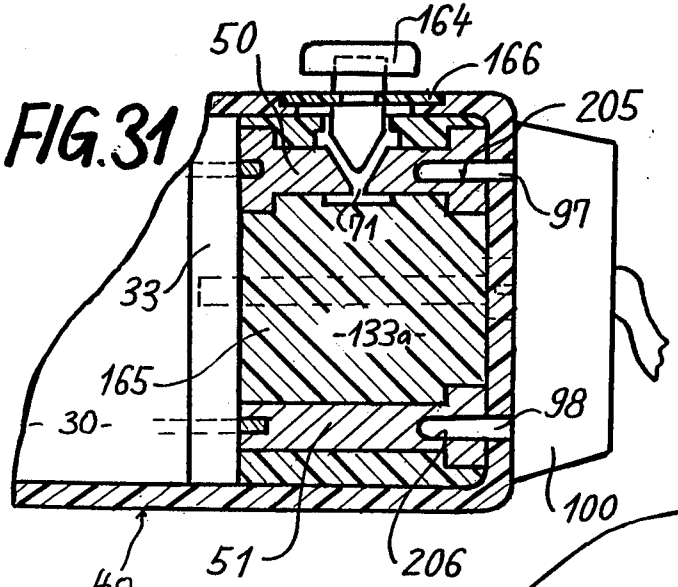
FIG. 31 is an axial sectional view of a fifth embodiment of switch means according to the invention with the parts in neutral position.
Figure 33:
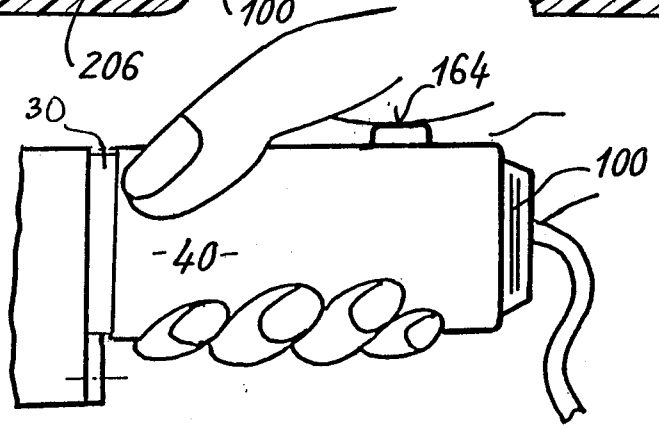
FIG. 33 is a side view of a rearward portion of a power tool apparatus according to the invention held in an operator's hand, which hand actuates the switch means illustrated in FIGS. 31 and 32.

Another, simplified embodiment of the switch means 12 is illustrated in FIGS. 31 to 33. In this embodiment, the cap member 40 is fixed on the motor housing 30, and the fixed contactor 51 extends across an interspace **133*a* to the cap end wall 40*a* in which a throughhole 206 leads to the contactor 51**.

The contactor 50 has a circuit-breaking gap 71 therein, but is otherwise of similar construction as the contactor 51, and can be connected electrically via a throughhole 205, when the prongs 97 and 98 of the plug 100 are inserted in these throughholes. In order to make circuit as shown in FIG. 32, a contact pin 164 which is mounted in a flexible membrane 166, must be depressed by the operator.

The entire interspace **133*a* can be filled by a base element 165 which is attached firmly on the motor housing end wall and the cap end wall 40*a***.

In the following FIGS. 34 to 43, there are illustrated several tools suitable for being affixed to the front end of the power tool apparatus according to the invention described hereinbefore. In order to be acceptable as items in the kit according to the invention, all of these tools require in their construction connecting means adapted to the aforesaid apparatus front end. The common features of these connecting means shall now be described in detail.

The front end of the power tool apparatus comprises the bearing-wall 8 which has a main wall portion detachably, but rigidly mounted in the open front end 4*a* of the enveloping shell 1, the above-mentioned central opening 8*a* and the bearing 9 in which there is lodged the forward end of the power-transmitting inset unit 10 lodged in the forward shell chamber 4, which inset unit comprises a forward shaft end 95, preferably as a polygonal, in particular a square head end, which shaft end 95 protrudes from the bearing 9 to the outside.

Moreover a centering body portion 94 projects forward of the shell front end 4*a* and surrounds the bearing 9. The external annular face 96 extending in axial direction about this forward body portion 94 constitutes a cylindrical or slightly frustonconical centering face.

Preferably, at the annular zone where the projecting portion 94 merges with the main body of the bearing-wall 8, there is provided an annular groove 196.

Figure 42:
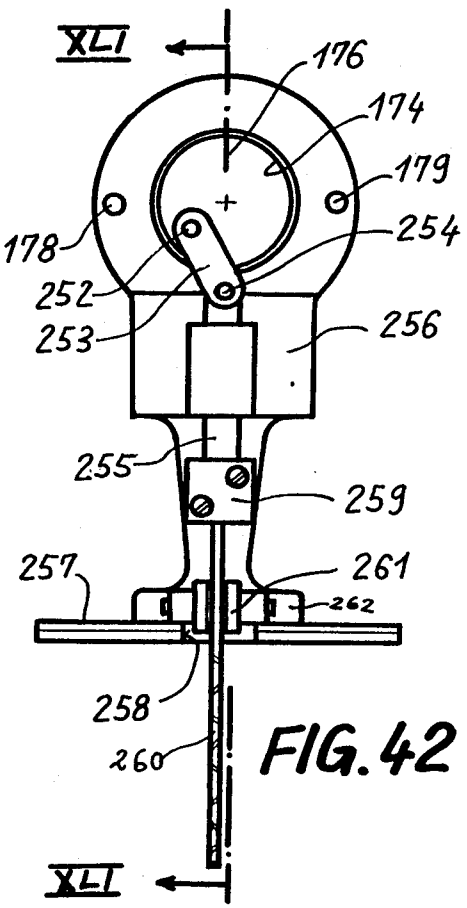
FIG. 42 is a front view of the straight-blade saw unit shown in FIG. 41, after removal of a protective shield.

Fastening means such as screw bolts insertable into corresponding bores in the forward annular face 8*b* of the bearing-wall 8 radially outside the body portion 94 thereof, or clamping means as illustrated in FIG. 42, infra, have been represented schematically or omitted for the sake of clarity, as the art-skilled are familiar with them.

The corresponding bores in the connecting sockets of the tools described hereinafter have been omitted likewise or indicated by dashed and dotted lines, e.g. in FIG. 2.

Figure 34:
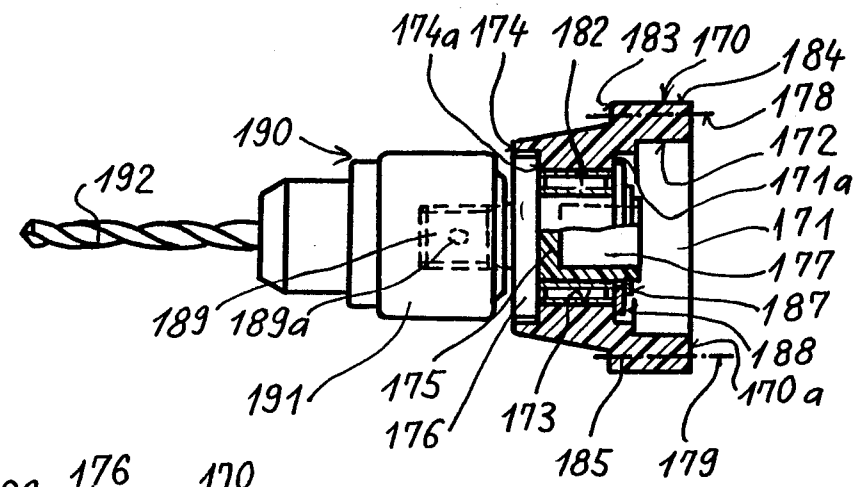
FIG. 34 shows in a lateral, partially axially sectional view a drilling tool having connecting means according to the invention.
Figure 35:
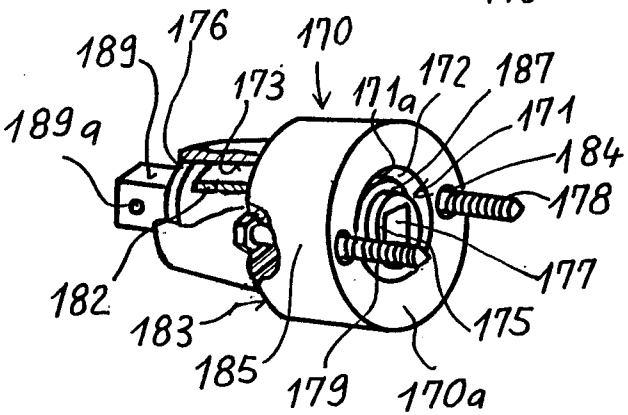
FIG. 35 shows in a perspective view the connecting socket body being a part of the connecting means shown in FIG. 34.
Figure 36:
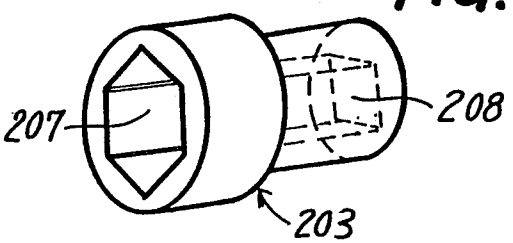
FIG. 36 shows in a perspective view a socket tool adapted for tightening and for loosening nuts, having similar connecting means as shown in FIG. 34.

The connecting socket unit being a part of the drilling tool shown in FIG. 34 comprises the connecting socket body 170 having a rearward face 170*a* and a central cavity 171 therein. The cavity sidewall 172 is cylindrical or slightly conically tapered to widen outwardly and fit with good centering on to the correspondingly shaped annular face 96 of the bearing-wall body portion 94.

The socket body 170 has a central axial bore or throughhole 173 which opens to the rear in the bottom 171*a* of the cavity 171 and forwardly in a recess 174*a* in the frontal face 174 of the socket body 170.

Into this throughhole 173 there is introduced from the front a connecting shaft piece 175 having a central collar 176 which comes to rest in the recess 174*a*. At its rearward end the shaft piece 175 has a rearwardly open cavity 177 of polygonal cross-sectional area, which is adapted to fit over the polygonal head end 95 of the intermediary shaft 5. Preferably, the head end 95 is a square head end and the cross-sectional area of the cavity 177 is then also a square one. It is important that the square or the like polygonal shaft end 95 fits with play into the cavity 177. Thereby, no centering problems will arise between the shaft 5 and the shaft member, as the socket body 170 is guided and centered by contact of the cavity sidewall 172 with the annular face 96 on the bearing-wall 8. Centering is further assured by corresponding tightening of the screw bolts 178 and 179 which extend on both sides of the shaft piece 175 from a shoulder 183 of the socket body 170 via bolt holes 184 and 185 in the latter toward the rear and out of the rearward face 170*a* of the socket body 170 to enter corresponding bores in the peripheral zone 180 of the frontal face 8*b* of the bearing-wall 8 (FIG. 1). Only the left-hand one, 181, of these bores is indicated in dashed outline in FIG. 2. The ends of the screwbolts 178 and 179 protruding rearwardly from the bearing-wall 8 to the right and to the left of the impact unit 10 can be secured by nuts (not shown) in a conventional manner.

The shaft piece 175 is supported rotatingly in the socket throughhole 173 by means of a bronze bushing 182 and, with the flange 176 resting in the recess 174*a*, a locking ring 187 and washer 188 fixed on the rearward shaft piece end secure the shaft piece 175 against axial displacement in the throughhole 173. In the case of the working tool illustrated in FIG. 34 the forward end of the shaft piece which protrudes from the collar 176 forward beyond the socket body 170, bears a square-head or the like end 189 of polygonal cross-sectional area. This head end can also have a transverse bore 189*a* for purposes to be described further below.

A conventional drill chuck 190 having a socket 191 fitting, e.g. by a thread connection, on to the head end 189 of the shaft piece 175 is shown in FIG. 34 holding clamped in position and exchangeably a drill bit 192. The parts of the drill chuck are well known and will not be described in detail.

A socket tool 203 serves for fastening or loosening bolts, by means of which, for instance, automobile wheels are mounted on their hubs or removed. The socket tool 203 therefore comprises a forward part having a polygonal recess 207 of, for instance, hexagonal cross-section when bolts having hexagonal heads are to be inserted therein, while the rearward portion of the socket tool 203 has an axial polygonal recess 208 of, for instance square cross-section, when the intermediary shaft 5 of the power tool apparatus according to the invention bears a square head end 95 (FIGS. 1 to 3).

Figure 37:
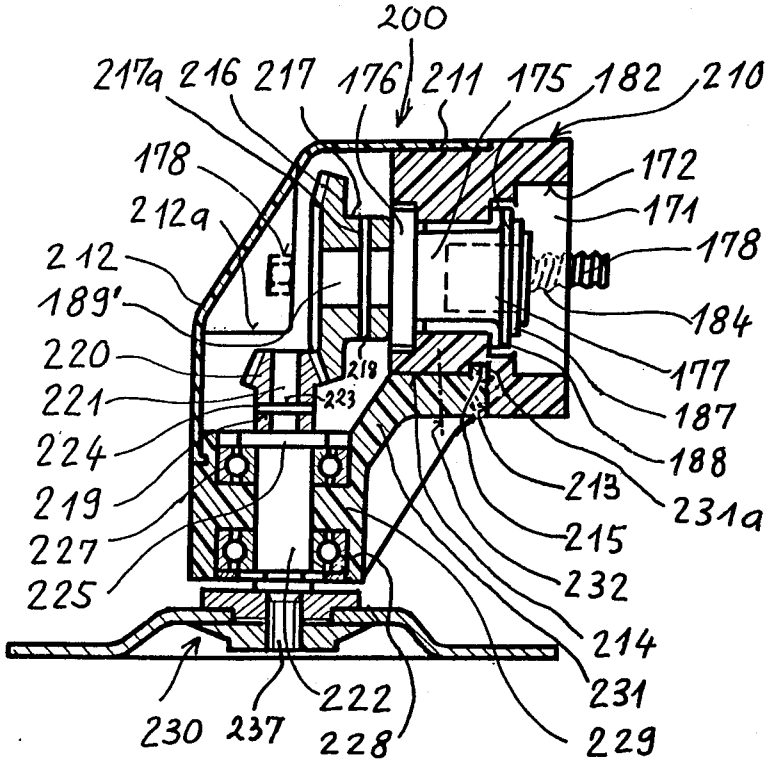
FIG. 37 shows in an axially sectional view an angle sander and cutting unit having similar connecting means as are shown in FIG. 34.

The rotary tool unit illustrated in FIG. 37 is an angle sander or a cutting tool and comprises a tool socket body which is almost identical with the connection socket body 170 shown in FIG. 34. All identical parts of the two socket bodies 170 and 210 bear like reference numerals. The difference between the two socket bodies lies in the external configuration of their central and forward portions.

The entire tool socket body 200 including its forward portion is of practically cylindrical configuration, but has in its upper forward region a semi-annular recess 211 provided to receive the rearward end of a closing shield 212 therein, while in its lower forward region, a cut-away segment provides a vertical shoulder 213 and flat underside face 214 as well as a transverse groove 215 where the shoulder and underside face meet.

On the forward end 189' of the shaft piece 175, which can be of circular in lieu of polygonal cross section, there is mounted a bevel gear 216 whose stem part 217 is provided with a transverse bore 217*a* registering with the transverse bore 189*a* of the forward shaft piece end 189' and can be fixed thereon by means of a cotter pin 218. It will be understood that by opening the shield 212, this bevel gear 216 is readily accessible and can be exchanged for another bevel gear of different toothing or pitch to obtain a different transmission ratio and higher or lower speed of the bevel gear 220. For instance, a speed of the intermediary shaft 5 and the shaft piece 175 of 2000 r.p.m. can be increased by a transmission ratio of 3:1 to a speed of 6000 r.p.m. and by a transmission ratio of 4:1 to a speed of 8000 r.p.m. of the vertical shaft 222 and the tool 230 mounted thereon.

The bevel gear 220 is mounted on the upper end 221 of a vertical shaft 222 by means of transverse bores 219 and 223 in the gear 220 and in the shaft upper end 221, respectively, which bores register with each other and have a cotter pin 224 inserted therein. The vertical shaft 222 bears an annular flange 225 integral therewith by means of which it rests on ball bearings 227 and 228 in a tool-bearing body 229.

At its lower end 237 the shaft 222 has attached thereto in a conventional manner a tool such as, in the instant case, a sander or rotary cutter 230.

At its upper end, the tool-bearing body 229 is provided with an extension constituting a bracket arm 231 which is shaped to fit snugly into the angular space provided on the connecting socket body 210 between the flat underside 214 and the vertical shoulder 213 and bears at the rearward end of its upper flat face a marginal, upwardly projecting rim **231*a* which fits into the transverse groove 215. The bracket arm 231 is firmly held in its position at the socket body 210** by means of a threaded bolt.

The rotary tool unit including the connecting socket body 210 is mounted firmly on the bearing-wall 8 of the front end of the power tool according to the invention by means of the threaded head bolts 178 and 179 (FIG. 35) whose hexagonal heads or nuts are lodged in niches **212*a* of the closing shield 212 (only the left-hand niche—looking at the shield from outside—is visible in FIG. 37) and are thus freely accessible. The shield 212 can be snapped into place on the socket body 210 and the tool-bearing body 229** and easily removed therefrom.

Figure 39:
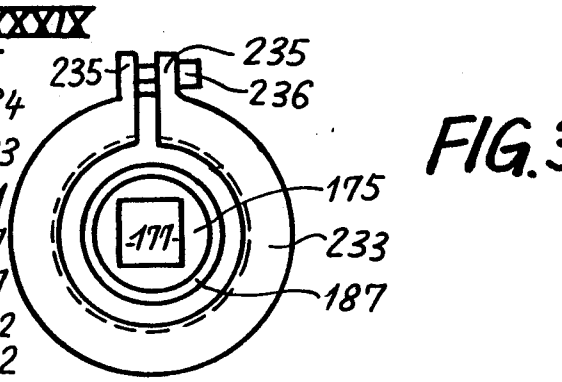
FIG. 39 is a bottom view of the hedgerow-cutting tool per se as shown in FIG. 38.
Figure 38:
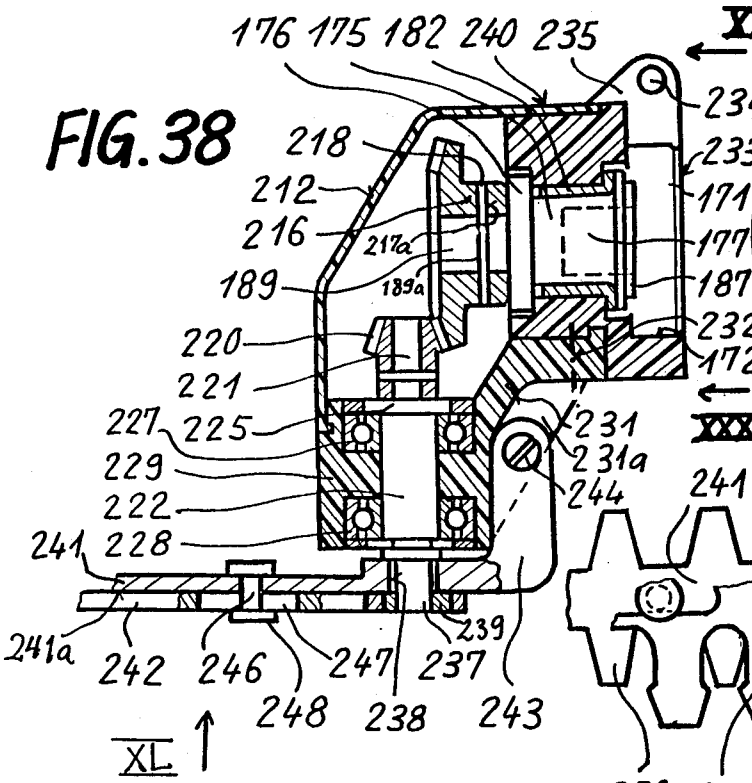
FIG. 38 is a partially axially sectional view of a hedgerow-cutting tool having a basic construction in common with the tool illustrated in FIG. 37, but with modified connecting means.
Figure 40:
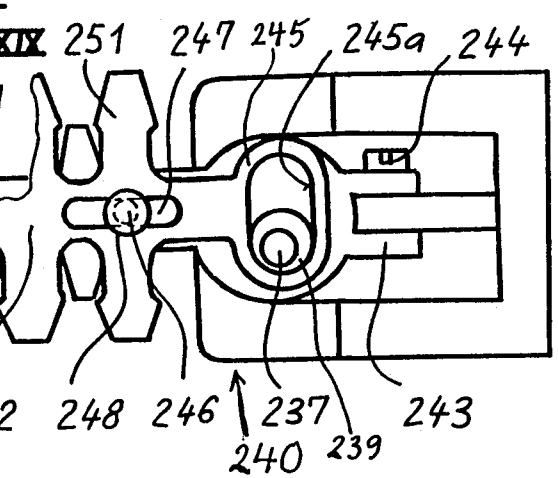
FIG. 40 is a rear end view of the tool shown in FIG. 38.

In the tool unit illustrated in FIGS. 38 to 40, the connecting socket body and the angle cutter structure attached thereto are almost identical with those described above relating to FIG. 37. Identical parts bear like reference numerals.

The means by which the tool unit of FIGS. 30–41 is attached to the bearing-wall 8 at the forward end of the power tool apparatus according to the invention are different from those described hereinbefore and are illustrated in detail in FIGS. 38 and 39. In lieu of the threaded bolts 178 and 179 (FIGS. 34, 35 and 37), clamping means are used which comprise a split, elastically outwardly biassed clamping ring 233 having holes 234 in each eyelet 235 and a clamp bolt 236 inserted in the eyelet holes 234.

A hedge clipper 240 is attached to the lower end of the vertical shaft 222 of the tool unit shown in FIG. 38. The clipper 240 comprises a stationary blade-bearing bar 241 and a movable blade-bearing bar 242. The stationary bar 241 is mounted on a reinforcing rib **231*a* of the bracket arm 231 of the tool-bearing body 229 by means of an angle piece 243 which is fastened to the bracket arm by a fastening screw connection 244 and is an integral upward extension of the stationary bar 241**.

As can be seen in FIGS. 38 and 40, the lower end 237 of the vertical shaft 222 extends downwardly below the stationary bar 241, through a bore 238 thereof, and bears an excenter disc 239 for rotation with the shaft 222. This excenter disc 239 is fitted into a slot **245*a* in an eyelet part 245 being at one end of the moveable bar 242 on the underside 241*a* of the stationary bar 241. The latter bar bears rivet studs 246 extending from its underside through elongated slots 247 in the moveable bar 242 and holding the bar 242 in contact with the stationary bar 241 thereabove by their lower enlarged rivet heads 248 while permitting a forward or backward axial displacement of the moveable bar 242 in the slots 247 relative to the stationary bar 241, thereby causing a shearing effect between the stationary bar blades 250 and the moveable bar blades 251. The backward and forward displacement of the moveable bar 242 is produced by the excenter disc 239 being rotated in the slot 245*a* by the vertical shaft 222 and thereby pushing the bar 242 to the left in FIG. 40 upon the shaft 222 rotating about 180°, and then pushing the bar 242 to the right, back to the limit position shown in FIG. 40**, during its rotation about the next following 180°.

Another cutting tool unit comprising a rotary blade can be obtained by the operator using the kit according to the invention by detaching the tool socket 229 and the bracket arm 231, the vertical shaft 222 and the bevel gear 220 from the unit by removing the bolt 232, and then exchanging the large bevel gear for a large rotary blade on a hub having the rearward stem part 216 and a transverse bore **217*a* therein which is adapted to register with the transverse bore 189*a* in the shaft head end 189. The large rotary blade can then be fastened on the shaft end 189 by means of a cotter pin 218**.

Figure 41:
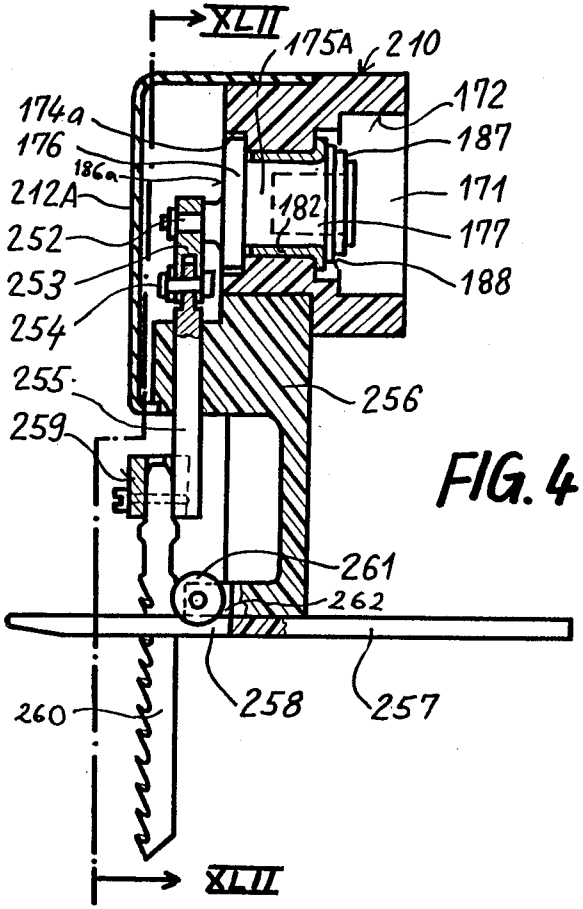
FIG. 41 is a partially axially sectional view of a straight-blade saw unit equipped with connecting means similar to those shown in FIG. 34.

A straight saw tool unit attachable to the power tool apparatus according to the invention is illustrated in FIGS. 41 and 42. This new tool unit comprises a tool socket body 210 as described hereinbefore in relation to FIG. 37, all identical parts bearing like reference numerals. However, the connecting shaft piece 175A therein has a differently constructed portion forward of the central collar 176 thereof. Instead of a polygonal forward head end 189 or 189' it bears a crank pin 252 mounted stationary and excentrically on the front face **186*a* of the shaft collar 176, or being integral with the latter, and bearing articulatedly a crank 253 the upper end of which engages the crank pin 252, while the lower crank end is connected articulatedly by means of a crank joint 254 with the top end of a downwardly extending driving rod 255 which is guided during reciprocating upward downward movement in an appropriate bore in a guiding block 256. The guiding block 256 is mounted stationary on a base plate 257 having a slot 258 therein, through which the straight saw blade 260 extends, which is attached exchangeably at its upper end to the lower end of the driving rod 255 by conventional attachment means 259. A guide roller 261 mounted for rotation in a forked holder 262 at the foot end of the guiding block 256 guides the saw blade 260** during its reciprocating movement.

Figure 43:
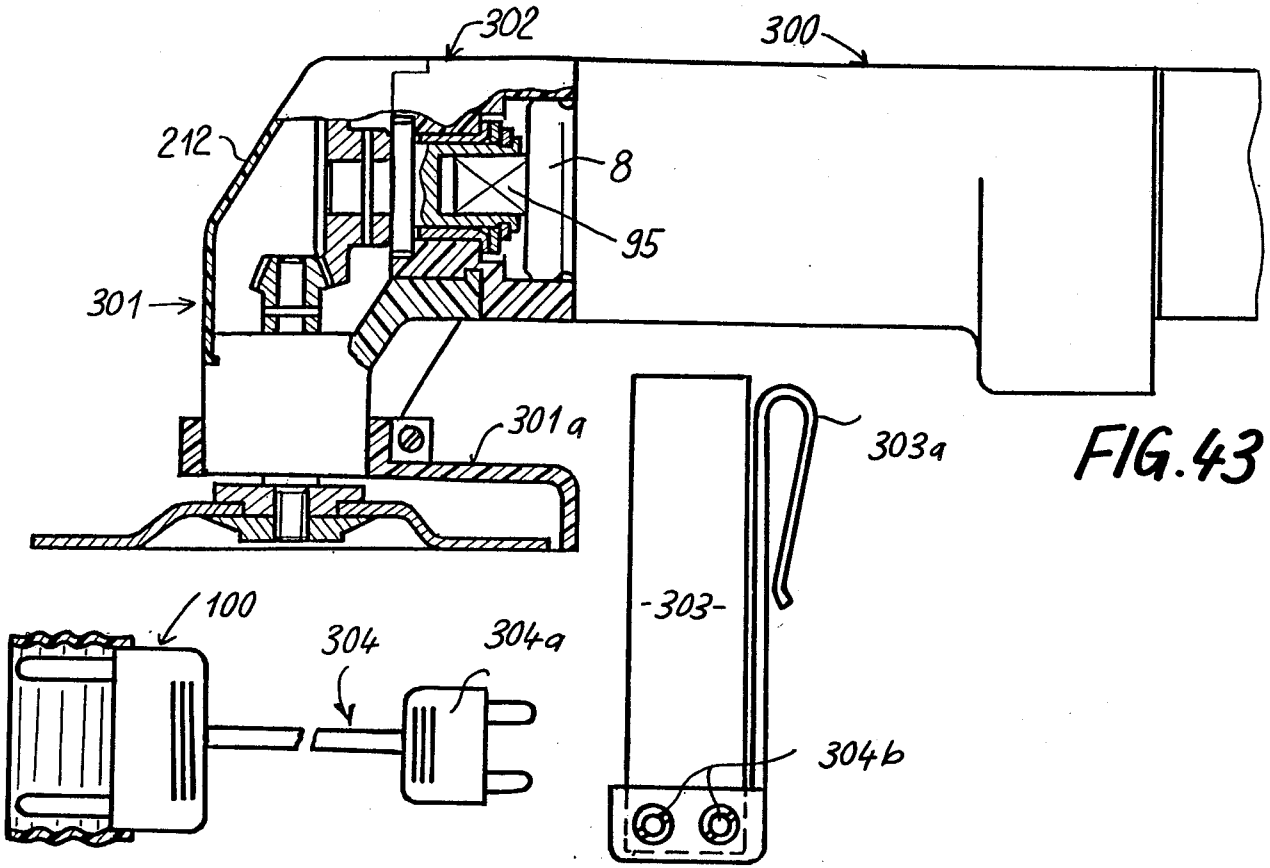
FIG. 43 shows items of a kit according to the invention, comprising the power tool apparatus according to the invention, a sanding and cutting tool adapted for attachment to the said apparatus and being similar to the tool shown in FIG. 37, as well as a portable battery and an electric cord therefor.

In FIG. 43 there is illustrated a kit according to the invention comprising a minimum of items. A power tool apparatus 300 according to the invention comprises the inset building block illustrated in FIGS. 2, **2*a* and 2*b*, an angle sander 301 together with a protecting shield 301*a* and a connecting piece 302, a portable battery 303 which can be suspended from a belt worn by the operator, by means of a loop 303*a*, and a connecting cord 304. The connecting cord is provided at one end with a smaller male plug 304*a* for connection with the female plug 304*b*, on the battery 303, and at the other end with a larger plug 100 destined to be inserted at the cap member 40 for instance as illustrated in FIG. 9**.

The battery 303 is preferably a nickel-cadmium battery delivery a direct current of 12 volts. Such a battery weights approximately 1300 g and will last long enough to loosen 500 automobile wheel nuts each of a diameter of 10 mm, each with an energy consumption of 64 Newton-meters.

I claim:

1. A working kit suitable for hobby work as well as constructional and the like heavy duty work, comprising (I) an electric rotary power tool apparatus holdable by hand during operation and consisting essentially of (A) a first building block comprising (1) an apparatus casing consisting essentially of an elongated assembly having a longitudinal axis and comprising (1.1) an enveloping shell extending generally in the direction of said longitudinal assembly axis, and having an open front end and an open rear end;

(1.2) a first transverse wall being integral with said enveloping shell and extending across the interior of said shell in a region thereof intermediate said front end and said rear end and being axially spaced from both said shell ends so as to divide the shell interior into a forward chamber and a rearward chamber; said first transverse wall having a throughhole therein;

(1.3) a second transverse wall across said open rear end of said shell and being detachably mounted therein; said second transverse wall having an opening therein; and (1.4) a speed-reducing unit mounted on said second transverse wall on the side thereof facing toward said first transverse wall, and being adapted for fitting into said rearward shell chamber; said speed-reducing unit comprising a driven power-transmitting shaft having a front shaft end adapted for fitting through said first transverse wall throughhole and protruding therefrom into said forward shell chamber;

said speed-reducing unit comprising a gear train consisting essentially of a plurality of gears and a number of transmission shafts each bearing at least one of said gears, one of said gears being a pinion, and one of said transmission shafts being a driven power-transmitting shaft, said transmission shafts being rotatingly supported in said first and second transverse walls, respectively; said gear train being adapted to reducing the speed of said pinion to that of said driven shaft in a ratio of from about 2:1 to about 12:1; and (B) a second, rearward building block comprising (2) a direct current electric motor comprising (2.1) a motor housing comprising a surrounding hull, a forward hull end and a rearward hull end wall, said motor housing being adapted for having said forward hull end firmly connected with said second transverse wall on the outside thereof;

(2.2) driving rotor shaft means having a longitudinal axis being substantially parallel with said longitudinal assembly axis and extending through the interior of said motor housing, said driving rotor shaft means comprising a rotor shaft being rotatably supported in said opening of said second transverse wall, and having a forward shaft end extending into said rearward shell chamber and bearing said pinion therein, for drivingly engaging said gear train;

(2.3) a rotor mounted inside said motor housing on said rotor shaft for rotating the latter;

(2.4) permanent magnet stator means adapted for generating an electromagnetic field in cooperation with said rotor adapted for excitation by a direct electric current having a potential of about 8 to 30 volts and an amperage sufficient for affording a power output of said motor, when idling, of at least 180 watt, and of at least about 620 watt under load;

(2.5) commutator means comprising (2.5.a) a commutator consisting essentially of collector segments and being mounted on said rotor shaft between said rotor and said rearward hull end wall;

(2.5.b) first and second brush means mounted in said motor housing and being biassed toward said collector segments for electrically conductive contact therewith and for delivery direct electric current to said rotor;

(2.5.c) first and second fixed contactors being electrically conductively connected with said brush means and being mounted stationary in said rearward hull end wall and having terminal contactor portions bearing contactable terminal regions thereon located in an interspace, beyond said rearward motor hull end wall, in said rearward building block, said contactable regions being located generally in a common planar interspace contact zone;

(2.5.d) electrically conductive lead means adapted for connecting said first brush means with said first fixed contactor, and said second brush means with said second fixed contactor, and being adapted for carrying direct electrical current of the voltage and amperage defined, supra, substantially free from electrical power losses;

(4) first electrical switch means being adapted for switching a direct electrical current having the voltage and amperage defined, supra, and comprising (4.1) a first supporting member having at least one electrically insulating face spaced from and substantially parallel with said planar interspace contact zone, said contactable terminal regions being arranged about a first central switch axis being normal to said electrically insulating face of said first supporting member;

said supporting member being adapted for pivoting displacement about said central switch axis, between a neutral position thereof and at least one activating position;

(4.2) socket throughholes through said supporting member and being adapted for receiving therein the prongs of an electrical plug being electrically connectable to a source of direct electrical current;

(4.3) at least two shiftable contactor elements being mounted on said electrically insulating face of said first supporting member so as to be insulated from each other, each of said contactor elements being associated with a different one of said socket throughholes to make substantially loss-free contact with a prong of a plug inserted in the respective throughhole;

and each of said shiftable contact members having a contact face of curved configuration about and on opposite sides of said first central switch axis;

(4.4) first biassing means associated with said rearward hull end wall and comprising first and second engagement means, (4.6) first fixed mounting means adapted for holding said first and second fixed contactors firmly in position therein relative to said first central switch axis, and being mounted fixedly on the outside of said rearward motor hull end wall;

said first engagement means being mounted on said first fixed mounting means, and said second engagement means being mounted on said first supporting member, said first and second engagement means being engaged with one another in a manner such that said supporting member is biassed toward said first planar contact face and said first mounting means;

(4.7) restoring means for restoring said first supporting member automatically form an activating position to said neutral position;

said rearward building block further comprising (5) a cap member adapted for covering at least a substantial portion of said surrounding hull of said motor housing and having a cap end wall extending substantially parallel with and spaced from the outside of said rearward housing end wall, an internal chamber being left free between said rearward hull end wall and the inner face of said cap end wall, through which internal chamber said first planar contact plane extends; said first supporting means being located inside said cap member vis-á-vis said cap end wall;

those socket throughholes being associated with said two shiftable contactor elements extending from outside said cap member and through the latter and also through said first supporting member, and two other, additional throughholes extending from outside said cap end wall and through said first supporting member thereon, and opening out of said electrically insulating face thereof to register with said contactable terminal regions of said first and second fixed contactors, respectively, when said supporting member is in neutral position;

said first and second engagement means of said first biassing means being pivotably engaged with each other, whereby said first supporting member in said cap member can be pivoted about said first central switch axis relative to said first mounting means by at least a small angle; and, when said first supporting member is in activated position, said biassing means urge said shiftable contactor elements against said contactable terminal regions of said first and second fixed contactors;

(II) at least one of the following kit items:

(a) an electrical cable having two ends and comprising at one end thereof connecting means for attachment to a source of direct electrical current, and at the other end an electrical plug comprising prong-receiving holes therein being electrically conductively connected, through said cable, with said connecting means, and prongs adapted for being mounted fixedly in at least one of (i) said socket throughholes of said first supporting member, and (ii) said prong-receiving holes of said plug;

(b) a handle part having at least two opposite handle sidewalls and being firmly and detachably connectable with said first building block, said handle part having a central longitudinal axis extending between said handle sidewalls and transversely to said central longitudinal motor housing axis;

said opposite handle sidewalls adapted for freely supporting said cap member and said first supporting member therein to be pivotable about said first central switch axis between said neutral position and an activating position;

said handle part comprising (7) second electrical switch means adapted for switching a direct electrical current having the voltage and amperage defined, supra, and comprising, about a second central switch axis, (7.1) a pair of third and fourth fixed contactors;

(7.2) second fixed mounting means adapted for being mounted on an inside face of one of said opposite handle sidewalls in said handle part and for holding said third and fourth fixed contactors firmly in position relative to said second central switch axis;

said third and fourths contactors protruding into an interspace between said opposite handle sidewalls and bearing third and fourth contactable regions, respectively, being located in a second planar contact zone;

(7.3) electrically conductive cord means extending through said handle part and having two ends, said third and fourth fixed contactor means being conductively connected with one end of said cord means; said ends of said cord means comprising (6.1) a handle cord plug conductively connected with said other end of said cord means, and (6.2) lead prongs on said cord plug adapted to be inserted, respectively, into said additional socket throughholes in said cap end wall and to make contact, through said first supporting member, with said contactable terminal regions of said first and second fixed contactors, respectively, while arresting said first supporting member in neutral position;

said second electrical switch means further comprising (7.5) a second supporting member having at least one electrically insulating face extending thereon spaced from, and substantially parallel with, said second planar contact zone;

(7.6) handle socket throughholes opening out of said handle part and being adapted for receiving therein prongs of an electrical plug of said electrical cable;

(7.7) at least two shiftable handle contactor elements mounted on said insulating face of said second supporting member, to be electrically insulated from each other, each of said handle contactor elements being associated with a different one of said handle socket throughholes to make substantially loss-free contact with connecting plug means of said electrical cable when said plug is inserted into said handle socket throughholes;

(7.8) second biassing means mounted in said handle part and comprising first and second engagement means adapted for cooperating with each other in biassing said second supporting member toward said second fixed mounting means, and being connected, for pivotal movement relative to each other, with said second supporting member and said second fixed mounting means, respectively;

said second supporting member comprising actuating means extending to the outside and having a depressable portion protruding to outside said handle when said second supporting member is in neutral position; depression of said depressable portion of said actuating means causing said supporting member to pivot about said second central switch axis from its neutral position to an activating position; and (7.9) second restoring means being in engagement with said second supporting member and said second fixed mounting means, respectively, and being adapted to cause restoring bias applied to said second supporting member when the same is pivoted from its neutral position to an activated position;

(c) a portable battery adapted for being carried on an operator's person, in combination with battery cable means adapted for being connected to said portable battery, on the one hand, and being adapted to be connected, on the other hand, with one of (iii) said two shiftable contactor elements of said first supporting member; and (iv) said shiftable handle contactor elements of said second supporting member;

(III) at least one of the following inset units comprising each of the following parts:

(3) insertable bearing-wall means adapted for being mounted transversely, detachably and in firm position in said open front end of said enveloping shell of said first building block, said insert bearing-wall means having a central axial throughhole and comprising (3.1) shaft-bearing means in said axial throughhole;

(3.2) an insertable power-transmitting intermediary unit comprising (3.2.a) insertable shaft means having a forward shaft end and a rearward insertable shaft end, said insertable shaft means being supportable for rotation in said shaft-bearing means engaging a region of said insertable shaft means near said forward shaft end, said rearward shaft end of said insertable shaft means being adapted, upon insertion into said forward chamber of said enveloping shell, for drivingly engaging said driven shaft front end protruding from said first transverse wall into said forward shell chamber;

(3.2.b) a square-head type connecting piece on said forward end of said insertable shaft means, and being located forward of said shaft-bearing means;

(3.3) centering socket means adapted for protruding forwardly out of said enveloping shell and being located spaced outwardly from said throughhole; and (3.4) tool-fastening means adapted for being located outside said enveloping shell and being spaced outwardly from said axial throughhole;

said insert units being constituted by:

(8A) an insert unit consisting of the parts defined under (3) through (3.4), supra, per se;

(8B) an insert unit comprising, besides the parts defined under (3) through (3.4), supra, (8.1) fan means mounted on said insertable shaft means in a region thereof, being located in the interior of said forward shell chamber, upon insertion of said unit therein; and (8.2) vent means provided in said transverse walls of said forward and rearward chambers of said enveloping shell, as well as in said insertable bearing-wall means;

(8C) an insert unit comprising, besides the parts defined under (3) through (3.4), supra, (8.3) an impact-generating unit mounted on said insertable bearing-wall means and on said insertable shaft means;

(8D) an insert unit comprising, besides the parts defined under (3) through (3.4), supra, a hammer drill mounted on said insertable shaft means;

all of said insert units fitting with the parts thereof rearward of said bearing-wall means, into said forward chamber of said enveloping shell; and said working kit further comprising:

(IV) at least one of the following tools each of which comprises (9) coupling means adapted for firm, detachable and centered coupling of the respective tool with said centering socket means; and

(10) tool operating shaft means comprising a coupling shaft end adapted for being drivingly connected with said square head-type connecting piece at the forward end of said insertable shaft means; and is constituted by (IV.1) nut-loosening and tightening socket means;

(IV.2) screw driver means;

(IV.3) a drilling tool;

(IV.4) a blade saw tool;

(IV.5) an angle tool comprising at least one of sander and cutter means.

2. An electric rotary power tool apparatus holdable by hand during operation and consisting essentially of (A) a first building block comprising (1) an apparatus consisting essentially of an elongated assembly having a longitudinal axis and comprising (1.1) an enveloping shell extending generally in the direction of said longitudinal axis, and having an open front end and an open rear end and being of one piece;

(1.2) a first transverse wall extending across the interior of said shell in a region thereof intermediate said front end and said rear end axially spaced from both said ends so as to divide the shell interior into a forward chamber and a rearward chamber; said first transverse wall having a throughhole therein and being integral with said shell;

(1.3) a second transverse wall across said open rear end of said shell and being detachably mounted therein; said second transverse wall having an opening therein, and (1.4) a speed-reducing unit mounted on said second transverse wall on the side thereof facing toward said first transverse wall, and being adapted for fitting into said rearward chamber in said enveloping shell; said speed-reducing unit comprising a driven power-transmitting shaft having a driven shaft front end adapted for fitting into said throughhole and protruding therefrom into said forward chamber;

(B) a second, rearward building block comprising (2) a motor comprising (2.1) a motor housing having a central longitudinal axis substantially parallel with said elongated assembly axis, and comprising a surrounding hull, a forward hull end, a rearward hull end wall, and being adapted for having said front end thereof rigidly connected with said second transverse wall on the outside of the latter;

(2.2) driving motor shaft means extending through the interior of said motor housing and being rotatably supported in said opening of said second transverse wall; said driving rotor shaft means having a forward shaft end extending into said rearward shell chamber and being adapted for drivingly engaging said speed-reducing unit therein;

(C) a third, inset building block adapted for being inserted in said forward shell chamber through the open front end thereof and comprising (3) insertable bearing-wall means adapted for being mounted transversely in rigid, detachable connection, in said open front end of said enveloping shell, and having a central axial throughhole; said insert bearing-wall means comprising (3.1) shaft-bearing means in said axial throughhole;

(3.2) intermediary power-transmitting insert means comprising (3.2.a) insert shaft means having a forward and a rearward shaft end, said rearward shaft end being adapted for driving engagement with said driven shaft front end protruding into said forward shell chamber; said insert shaft means being supported for rotation in said shaft-bearing means in a region of said insert shaft means near said forward shaft end thereof; and (3.2.b) a connecting piece on said forward shaft end and forward of said shaft bearing means;

(3.3) centering socket means adapted for protruding forward out of said enveloping shell and being located spaced outwardly from said throughhole; and (3.4) tool fastener-engaging means adapted to be located outside said shell and spaced outwardly of said axial throughhole;

the length of said enveloping shell forward chamber from said integral first transverse wall to said open shell front end being sufficient for receiving all parts of said third building block that are located rearward of said central axial throughhole in said insertable bearing-wall means;

the wall thickness and strength of said enveloping shell being sufficient for supporting, when held freely by hand during operation, in combination with said first building block, the entire second, rearward building block comprising said motor mounted on said second transverse wall, as well as said entire third, inset building block even when comprising heavy duty impact clutch means or the like, as part of said intermediary power-transmitting insert means;

and said motor comprised by said rearward building block is an electric motor comprising (2.3) a rotor mounted inside said motor housing on said driving rotor shaft means for rotating the latter;

(2.4) stator means adapted for generating an electric field for cooperation with said rotor; and (2.5) commutator means comprising (2.5.a.) a commutator consisting essentially of collector segments and being mounted on said driving rotor shaft means between said rotor and said rearward motor housing end wall;

(2.5.b.) first and second brush means mounted in said motor housing and biassed toward said collector segments for electrically conductive contact therewith to deliver electric current to said rotor;

(2.5.c.) first and second fixed contactor means being electrically conductively connected with said first and second brush means, respectively, and being mounted stationary in said rearward building block and having terminal portions located outside said rearward motor housing end wall, said fixed contactor terminal portions bearing contactable surface regions located generally in a substantially planar contact zone; and (2.5.d.) electrically conductive lead means adapted for connecting said first and second brush means, respectively with said first and second fixed contactor means, substantially free from electrical power losses.

3. The apparatus of claim 2, wherein said speed-reducing unit comprises a gear train consisting essentially of a plurality of gears and a number of transmission shafts each bearing at least one gear, one of said gears being a pinion adapted for being mounted on said forward shaft end of said driving rotor shaft means, and one of said transmission shafts being comprised by said driven power-transmitting shaft means; said transmission shafts being supported in said first and second transverse walls, respectively.

4. The apparatus of claim 3, wherein said speed-reducing unit is adapted for reducing the speed of said driving rotor shaft means to said driven power transmitting shaft means in a ratio of from about 7:1 to about 12:1.

5. The apparatus of claim 2, wherein said rearward building block further comprises (4) an electrical switch means being adapted for switching a direct electrical current comprising (4.1) a supporting member having at least one electrically insulating face located spaced from, and substantially parallel with, said substantially planar contact zone, and also remote from said rearward motor housing wall and said contact zone;

said contactable surface regions of said terminal fixed contactor portions being arranged about a common central switch axis extending normal with regard to said contact zone;

said supporting member being mounted in said rearward building block to be adapted for pivoting displacement about said central switch axis, between a neutral position and at least one activating position;

(4.2) socket throughholes extending through said supporting member and opening out of said electrically insulating face thereof, and being adapted for receiving therein each a prong of an electrical plug having at least two prongs and being electrically connectable to a source of electric current;

(4.3) at least two shiftable contactor elements being mounted on said electrically insulating face of said supporting member so as to be electrically insulated from each other, each of said contactor elements being located so close to a different one of said throughholes in said supporting member face as to make substantially loss-free contact with a prong of a plug inserted in the respective throughhole;

each of said shiftable contact members having a shiftable contact face extending in an arc about and on opposite sides of said central switch axis;

(4.4) biassing means mounted in said rearward building block and being adapted for biassing said shiftable contactor elements toward said fixed contactor means and thereby urging said contact faces of said shiftable contactor elements into said substantially planar contact zone; said contact faces extending in said arcs being separated by gaps between them exposing non-conductive areas which said biassing means urge against said contactable surface regions of said terminal fixed contactor portions when said supporting member is in neutral position, thereby preventing electric current flow from said shiftable contact faces into said contactable surface regions; said non-conductive area gaps being sufficiently small for permitting current flow, when said supporting member is pivoted by a small angle about said central switch axis and away from said neutral position, from a source of electric energy via said plug prongs and said shiftable contact faces into said contactable surface regions, thereby energizing said electric motor.

6. The apparatus of claim 5, wherein said rearward building block comprises (5) a cap member adapted for covering said rearward motor housing end wall as well as a substantial portion of said surrounding hull of said motor housing on the outside, and having a cap end wall extending substantially parallel with said rearward motor housing end wall and having an inner wall surface, an internal chamber being left free between said inner wall surface and said rearward motor housing end wall;

said supporting member of said electrical switch means being located vis-á-vis said inner face of said cap end wall and cap throughholes extending from outside said cap end wall to said inner face thereof facing said supporting member; and said biassing means comprise first and second engagement means, mounted on the outside of said rearward motor housing end wall and on said insulating supporting member face, respectively, and cooperating with each other in biassing said supporting member toward said rearward motor housing end wall and, when said supporting member is in neutral position, urging said non-conductive gap areas against said contactable terminal portion surface regions, and, when said supporting member is in an activating position, urging said contact faces of said shiftable contactor elements against said contactable surface regions in said substantially planar contact zone.

7. The apparatus of claim 5, wherein said shiftable contactor elements are arc-shaped and extend each over an arc constituting a major portion of a half circle about said central switch axis, said arc-shaped contactor elements having at least one end thereof beveled to form a ramp facilitating sliding of the contact face thereon on to the respective contactable surface region of the nearest terminal fixed contactor portion, when said supporting member is pivoted through a small angle from the neutral to an activating position.

8. The apparatus of claim 5, wherein said electrical switch means comprise restoring means for returning said supporting member automatically from an activating position to its neutral position, said restoring means comprising a shaft member whose cross sectional area of elongated configuration having a larger diameter in a first direction and a smaller diameter in a second direction at right angle to said first direction, and two elastically flexible blade members lying firmly and straight against opposite flanks of said shaft member spaced from each other by said smaller diameter when said supporting member is in neutral position, and lying with biassing torque against two other opposite flanks of said shaft member, spaced by said larger diameter from each other when said supporting member is in an activating position, said torque biassing said shaft member to return to its neutral position, one of the two parts being constituted by said supporting member insulating face and said rearward motor housing end wall bearing said shaft member and the other part by said two blade members.

9. The apparatus of claim 6, wherein said supporting member has a circumferential rim and is mounted in said cap member pivotably about said central switch axis; said cap member being connected rigidly with said rearward motor housing wall; and said supporting member comprises (4.1.a) a switch-shifting member protruding tangentially from said supporting member rim; and wherein said cap member has a window registering with said switch-shifting member through which window said switch-shifting member protrudes when said supporting member is in neutral position; depression of the protruding end of said switch-shifting member causing said supporting member to turn about said central switch axis and shift from its neutral to an activating position.

10. The apparatus of claim 5, wherein said rearward building block comprises (6) a handle part having at least two opposite handle sidewalls and being firmly connectable with said first building block, said handle part having a central longitudinal axis extending transverse relative to said longitudinal building block assembly axis;

said electrical switch means comprising (4.5) stationary mounting means adapted for holding said first and second fixed contactor means firmly in position therein relative to said central switch axis, and being mounted in said handle part on an inside face of one of said opposite handle sidewalls;

and said supporting member being mounted, pivotably relative to said central switch axis, on an inside face of the other handle sidewall, in cooperative juxtaposition to said fixed contactor means on said stationary mounting means.

11. The apparatus of claim 10, wherein said supporting member has a circumferential rim and comprises (4.1.a) at least one switch-shifting member protruding tangentially from said supporting member rim, said handle part having window means through which said switch-shifting member is adapted to protrude when said supporting member is in neutral position; depression of the protruding end of said switch-shifting member causing said supporting member to turn by a small angle about said central switch axis and to shift from its neutral to an activating position.

12. The apparatus of claim 6, wherein said electrical switch means comprise (4.6) stationary mounting means adapted for holding said first and second fixed contactor means firmly in position therein relative to said central switch axis, and being mounted firmly on the outside of said rearward motor housing end wall;

said first and second engagement means of said biassing means are aligned with each other along said central switch axis and are pivotably connected with said cap member and said supporting member therein, and with said stationary mounting means, respectively;

(4.7) restoring means being in engagement with said supporting member and comprising arresting means adapted for being held in said stationary mounting means so as to cause restoring bias applied to said supporting member when the latter is pivoted from its rest position to an activating position; and wherein said rearward building block further comprises (6) a handle unit having at least two opposite handle sidewalls and being firmly connectable with said first building block, said handle unit having a central longitudinal axis extending between said handle sidewalls and transversely to said central longitudinal motor housing axis;

said opposite handle sidewalls having upper end portions adapted for freely supporting said cap member in a manner such that said cap member and said supporting member therein can be pivoted between said neutral position and an activating position of said supporting member;

said handle unit containing (7) a second electrical switch having a second central switch axis and comprising (7.1) a pair of third and fourth fixed contactor means, (7.2) second stationary mounting means adapted for holding said third and fourth fixed contactor means firmly in position therein relative to said second switch axis, and being mounted in said handle unit on an inside face of one of said opposite handle sidewalls;

said third and fourth fixed contactor means having terminal portions protruding into an interspace between said opposite handle sidewalls from said second mounting means, and bearing fixed third and fourth contactable surface regions, respectively, located generally in a second planar contact zone;

(7.3) electrically conductive cord means extending through said handle unit, having two ends one thereof being connected to said third and fourth contactor means; said cord means comprising at the other end thereof plug means adapted for being inserted through said cap member into contact with said contactable regions of said first and second contactor means;

(7.4) secondary throughholes in said cap member for rendering said contactable regions of said first and second contactor means accessible to contact by plug means inserted in said secondary throughholes;

(7.5) a second supporting member having at least one electrically insulating face located spaced from, and substantially parallel with said second planar contact zone;

(7.6) handle socket throughholes opening out of said handle unit and being adapted for receiving in each throughhole plug-connecting means associated with an electrical plug being connectable to a source of electric direct current;

(7.7) at least two shiftable handle contactor elements being mounted on said insulating face of said second supporting member so as to be electrically insulated from each other, and close to said handle socket throughholes so as to make substantially loss-free contact with said plug-connecting means when said electrical plug mentioned under (7.6), supra, is connected to said handle socket throughholes;

(7.8) second biassing means mounted in said handle unit and comprising first and second engagement means mutually pivotably engaged and cooperating with each other in biassing said second supporting member toward said second stationary mounting means, while being pivotable relative to each other, together with said second supporting member and said second stationary mounting means;

said second supporting member having a peripheral rim and comprising (7.5.a) at least one switch-shifting member tangentially protruding from said rim of said second supporting member, said handle unit having window means through which said switch-shifting member is adapted to protrude when said second supporting member is in neutral position; depression of the protruding end of said switch-shifting member causing said supporting member to turn about a small angle about said second central switch axis and thereby to shift from its neutral to an activating position; and (7.9) second restoring means being in engagement with said second supporting member and comprising second arresting means being held in said second stationary mounting means so as to cause restoring bias to be applied to said second supporting member when the same is pivoted from its neutral position to an activated position.

13. The apparatus of claim 6, wherein said first and second engagement means of said biassing means are aligned with each other along said central switch axis and are pivotally connected with said supporting member inside said cap member and with said rearward motor housing end wall, respectively; and said rearward building block comprises (6) a handle part having at least two opposite handle sidewalls and being firmly connectable with said first building block, said handle part having a central longitudinal axis extending between said sidewalls and transversely to said longitudinal building block assembly axis;

said opposite handle sidewalls having upper end portions adapted for freely supporting said cap member for rotating motion of the latter relative to said sidewalls between said rest position and an activating position of said supporting member; and said handle part comprising (6.1) pivoting means for causing a pivoting motion of said cap member from said rest position to an activating position of said supporting member therein, said pivoting means being located in said handle and extending into engagement with said cap member in an underside region of the latter intermediate said handle sidewalls; and (6.2) pivot-actuating means lodged in said handle part and adapted for being depressed from outside said handle part, thereby causing said cap member to pivot from said rest position to an activated position of said supporting member;

said electrical switch means further comprising (4.7) restoring means for restoring said supporting member, and said cap member together therewith, automatically from an activating position to said neutral position.

14. The apparatus of claim 13, wherein said restoring means are mounted in said handle part and are in restoring engagement with said pivoting means therein.

15. The apparatus of claim 13, wherein said restoring means are in restoring engagement with said supporting member and comprise arresting means;

and said electrical switch means further comprise (4.6) stationary mounting means adapted for holding said first and second fixed contactor means firmly in position therein relative to said central switch axis, and being mounted on the outside of said rearward motor housing end wall;

said arresting means being held in said stationary mounting means so as to cause restoring bias of said restoring means exerted on said supporting member when the latter is pivoted from its neutral position to an activating position.

16. The apparatus of claim 2, wherein said rearward building block comprises (5) a cap member adapted for covering said rearward motor housing end wall as well as at least a substantial portion of said surrounding motor housing hull on the outside thereof, said cap member having a cap end wall extending substantially parallel with said rearward motor housing end wall;

said first and second fixed contactor means extending to said cap end wall, (4.2) socket throughholes extending through said cap end wall to the outside thereof and registering with said contactable surface regions of said fixed contactor terminal portions and being adapted for receiving prongs of an electrical plug having at least two such prongs and being connectable to a source of electric current; whereby prongs inserted into said socket throughholes ana be connected conductively with said contactable surface regions;

one of said first and second fixed contactor means having a circuit-breaking gap therein; and said electrical switch comprises (4.3) a circuit making element mounted in said cap member and being adapted for radial inward displacement by outside pressure being applied thereto, so as to bridge said gap in said one fixed contactor means and thereby make circuit; said circuit-breaking element being biassed into undepressed, circuit-breaking position.

* * * * *